US011492156B2

(12) United States Patent
Campbell

(10) Patent No.: US 11,492,156 B2
(45) Date of Patent: Nov. 8, 2022

(54) ADJUSTABLE TABLES FOR USE IN PACKAGE FORMING SYSTEMS AND RELATED METHODS

(71) Applicant: Automated Solutions, LLC, Sawmills, NC (US)

(72) Inventor: Robert L. Campbell, Hickory, NC (US)

(73) Assignee: Automated Solutions, LLC, Sawmills, NC (US)

( * ) Notice: Subject to any disclaimer, the term of this patent is extended or adjusted under 35 U.S.C. 154(b) by 28 days.

(21) Appl. No.: 16/877,850

(22) Filed: May 19, 2020

(65) Prior Publication Data

US 2020/0385154 A1 Dec. 10, 2020

Related U.S. Application Data

(63) Continuation of application No. 15/684,934, filed on Aug. 23, 2017, now Pat. No. 10,654,599.
(Continued)

(51) Int. Cl.
*B65B 59/00* (2006.01)
*B65B 11/50* (2006.01)
(Continued)

(52) U.S. Cl.
CPC ..... *B65B 11/50* (2013.01); *B65B 9/02* (2013.01); *B65B 9/026* (2013.01); *B65B 25/14* (2013.01); *B65B 35/24* (2013.01); *B65B 41/16* (2013.01); *B65B 45/00* (2013.01); *B65B 51/30* (2013.01); *B65B 51/303* (2013.01); *B65B 57/00* (2013.01); *B65B 59/00* (2013.01); *B65B 59/001* (2019.05);
(Continued)

(58) Field of Classification Search
CPC .. B65B 9/02; B65B 9/06; B65B 43/04; B65B 43/06; B65B 5/04; B65B 5/06; B65B 11/00; B65B 11/06; B65B 11/105; B65B 11/50; B65B 61/00; B65B 59/00; B65B 59/001; B65B 59/003; B65B 59/02; B65B 2210/04
USPC ..... 53/450, 203, 545, 548, 553; 493/193
See application file for complete search history.

(56) References Cited

U.S. PATENT DOCUMENTS 377,657 A 2/1888 Weitmyer
3,201,914 A 8/1965 Lohse et al.
(Continued)

FOREIGN PATENT DOCUMENTS

EP 3092993 A1 11/2016

OTHER PUBLICATIONS

International Search Report and Written Opinion for Application No. PCT/US2017/048278 dated Dec. 20, 2017.
(Continued)

*Primary Examiner* — Gloria R Weeks
(74) *Attorney, Agent, or Firm* — Michael Best & Friedrich LLP

(57) ABSTRACT

Adjustable tables for use in packaging forming systems and related methods are provided. An adjustable table for use in a packaging forming system can include outer side panels and moveable inner side panels moveably connected to the outer side panels with the outer side panels held stationary relative to the moveable inner side panels. The adjustable table can also include a table top secured to the moveable inner side panels. The table top and the inner side panels are configured to move upwardly or downwardly relative to the outer side panels.

21 Claims, 19 Drawing Sheets

Related U.S. Application Data

(60) Provisional application No. 62/378,432, filed on Aug. 23, 2016.

(51) Int. Cl.

| | |
|---|---|
| ***B65B 25/14*** | (2006.01) |
| ***B65B 9/02*** | (2006.01) |
| ***B65B 51/30*** | (2006.01) |
| ***B65B 59/02*** | (2006.01) |
| ***B65B 35/24*** | (2006.01) |
| ***B65B 41/16*** | (2006.01) |
| ***B65B 45/00*** | (2006.01) |
| ***B65B 57/00*** | (2006.01) |
| ***B65B 65/00*** | (2006.01) |
| ***B65B 61/06*** | (2006.01) |

(52) U.S. Cl.

CPC ..... *B65B 59/02* (2013.01); *B65B 61/06* (2013.01); *B65B 65/00* (2013.01); *B65B 2210/04* (2013.01)

(56) References Cited

U.S. PATENT DOCUMENTS 3,662,513 A * 5/1972 Fabbri ..... B65B 11/54 53/222
3,686,820 A * 8/1972 Zenger ..... B65B 9/02 206/445
3,707,063 A * 12/1972 McIntyre ..... B65B 63/04 493/414
3,868,809 A * 3/1975 Bledsoe ..... B30B 9/3082 100/218
4,035,983 A * 7/1977 Shanklin ..... B65B 9/06 198/721
4,068,564 A * 1/1978 Dahlstrom ..... B65H 18/14 242/546.1
4,185,442 A 1/1980 Johnson et al.
4,399,675 A 8/1983 Erdmann et al.
4,567,711 A 2/1986 Hodnett et al.
4,574,566 A 3/1986 Eaves
4,585,508 A * 4/1986 Ehlers ..... B29C 65/18 156/494
4,601,157 A 7/1986 Adelman
4,679,379 A * 7/1987 Cassoli ..... B65B 9/073 100/232
4,807,420 A 2/1989 Barker
4,875,328 A * 10/1989 Meyer ..... B65B 25/146 100/291
4,983,154 A * 1/1991 Nagahashi ..... B31B 50/00 493/310
5,256,864 A 10/1993 Rando et al.
5,269,122 A * 12/1993 Reichental ..... B65B 9/02 53/371.4
5,284,003 A * 2/1994 Goodman ..... B65B 5/061 198/762
5,331,788 A * 7/1994 Cinotti ..... B65B 11/20 53/228
5,444,964 A 8/1995 Hanagata
5,447,099 A 9/1995 Adams et al.
5,553,550 A 9/1996 Doyle
5,603,801 A 2/1997 DeFriese
5,660,662 A 8/1997 Testone
5,685,814 A * 11/1997 Le ..... B65B 51/067 493/117
5,704,481 A * 1/1998 Lutz ..... B65D 75/20 206/469
5,881,532 A * 3/1999 Kitagawa ..... B65B 5/061 53/251
5,904,237 A * 5/1999 Sander ..... B65H 29/12 198/502.2
5,941,048 A 8/1999 Spitler
6,094,888 A * 8/2000 Pazdernik ..... G01M 3/36 53/436
6,474,141 B1 * 11/2002 Takaoka ..... B65B 57/00 73/49.3
6,622,767 B2 9/2003 Stork
6,658,819 B2 * 12/2003 Gamberini ..... B65B 11/10 53/436
6,880,314 B2 * 4/2005 Haasl ..... B65B 25/146 53/375.8
6,895,732 B2 5/2005 Sperry et al.
6,971,221 B2 * 12/2005 Sperry ..... B65B 9/026 53/373.5
7,107,823 B1 * 9/2006 Lovvorn ..... G01M 3/36 73/41
7,331,153 B1 2/2008 Sperry et al.
7,386,968 B2 6/2008 Sperry et al.
7,506,486 B2 * 3/2009 Wegner ..... B65B 25/14 198/413
7,603,831 B2 * 10/2009 Sperry ..... B65B 57/12 53/450
7,610,737 B2 * 11/2009 Kovacs ..... B65B 9/067 53/374.6
7,654,386 B2 * 2/2010 Dall'omo ..... B65B 25/146 198/803.13
7,681,380 B2 * 3/2010 Ouellette ..... B65B 9/02 53/209
7,886,502 B2 * 2/2011 Sperry ..... B65B 9/02 53/55
3,033,081 A1 10/2011 Sperry et al.
8,065,862 B2 * 11/2011 Mansuino ..... B65B 11/50 53/221
8,881,888 B2 * 11/2014 Overley ..... B65B 59/04 198/345.3
9,132,971 B2 * 9/2015 Overly ..... B65G 47/30
9,186,874 B1 11/2015 Bezanilla et al.
9,938,028 B2 * 4/2018 Koyama ..... B65B 11/54
2003/0046905 A1 * 3/2003 Kaechele ..... B29C 65/7439 53/459
2003/0050166 A1 * 3/2003 Dominguez, Jr. ..... B65B 9/20 493/296
2004/0045261 A1 3/2004 Sperry
2006/0218884 A1 * 10/2006 Sperry ..... B65B 9/02 53/450
2008/0035390 A1 2/2008 Wurz
2009/0308965 A1 12/2009 Piucci et al.
2014/0123881 A1 5/2014 Quiring et al.
2018/0086486 A1 3/2018 Campbell
2018/0086488 A1 3/2018 Campbell
2018/0086491 A1 3/2018 Campbell

OTHER PUBLICATIONS

International Search Report and Written Opinion for Application No. PCT/US2017/048288 dated Dec. 20, 2017.
International Search Report and Written Opinion for Application No. PCT/US2017/048292 dated Nov. 29, 2017.

* cited by examiner

ADJUSTABLE TABLES FOR USE IN PACKAGE FORMING SYSTEMS AND RELATED METHODS

RELATED APPLICATION

The presently disclosed subject matter is a continuation patent application of U.S. patent application Ser. No. 15/684,934, filed Aug. 23, 2017, which claims the benefit of U.S. Provisional Patent Application Ser. No. 62/378,432, filed Aug. 23, 2016, the disclosures of these patent applications are incorporated herein by reference in their entireties. U.S. patent application Ser. No. 15/684,887, filed Aug. 23, 2017, is also incorporated herein by reference in its entirety.

TECHNICAL FIELD

The present subject matter relates to shipping package forming apparatuses, systems, and related methods. In particular, the present subject matter relates to apparatuses and systems that form and aid in forming packages, such as envelopes, around physical items that are being shipped in the packages.

BACKGROUND

The advent of online purchasing, through such e-commerce website as Amazon or online box stores, such as Walmart online, have created a need for packaging items that are bought by a customer online and then shipped from a distribution center to the customer. These distribution centers must process thousands of items of various sizes.

These items include all of the various that are sold in mass on these e-commerce websites. Such items can include, but are not limited to: jewelry, such as rings, bracelets, necklaces, key rings, etc.; utility items, such as knives of various sizes, tools, etc.; electronics, such as cellular phones, tablet devices, televisions, computers, flash drives or other fobs, etc.; personal care items, such as make-up items, moisturizers and creams, razors, brushes, combs, hair dryers, etc.; apparel, such as dresses, pants, skirts, shorts, shirts, belts, shoes, socks, etc.; home furnishings, such as pillows, sheets, fabric coverings, etc.; toys of various sizes; and books of various sizes.

Due to the varied sizes of the items being processed in these distribution centers, packaging these items can be problematic. Having to separately package items can be labor intensive and time-consuming. Such problems can be partially addressed by separately items to be shipped from a fulfillment center by size. For smaller items, known as "smalls," such as books, jewelry, apparel, etc., envelope forming machines can be used to form envelope packages around the smaller items. These envelope forming machines allow placement of the smaller items between two sheets of material that for the envelope that will form the packing around the smaller item. The envelope forming machine can press and seal the sides and press, seal, and cut the ends to form the package around the smaller item.

While these envelope forming machines can speed up the packaging and shipping process, the current envelope forming machines still have many drawbacks that cost processing time, can raise labor costs, and can hurt the quality of the packages being formed. For example, with current envelope forming machines, even slight variations in height of the items can misalign the sheets of material that can in turn cause weak seals along the sides of the package, and depending on the product used to form the sealed sides, can expose adhesives, sealants, or other tacky substances to exterior of the package. Additionally, due to the mechanisms used to cut and seal the ends of the package, weakened seals are often formed leading to a tendency for one or both ends of the package to open unintentionally, for example, during shipping.

As such, a need exists, for example, for shipping package forming apparatuses and systems that can more effectively form packaging around a wider range of sizes of items to be shipped, while also providing sturdier packages that will not unintentionally open during shipping.

SUMMARY

The present subject matter provides package forming apparatuses, systems, and related methods. In particular, the present subject matter relates to apparatuses and systems that form and aid in forming packages, such as envelopes, around physical items that are being shipped in the packages. Methods related to the manufacture and use of the shipping package forming apparatuses and systems as disclosed herein are also provided.

Thus, it is an object of the presently disclosed subject matter to provide package forming apparatuses and systems as well as methods related thereto. While one or more objects of the presently disclosed subject matter having been stated hereinabove, and which is achieved in whole or in part by the presently disclosed subject matter, other objects will become evident as the description proceeds when taken in connection with the accompanying drawings as best described hereinbelow.

BRIEF DESCRIPTION OF THE DRAWINGS

A full and enabling disclosure of the present subject matter including the best mode thereof to one of ordinary skill in the art is set forth more particularly in the remainder of the specification, including reference to the accompanying figures, in which.

Figure 1A:
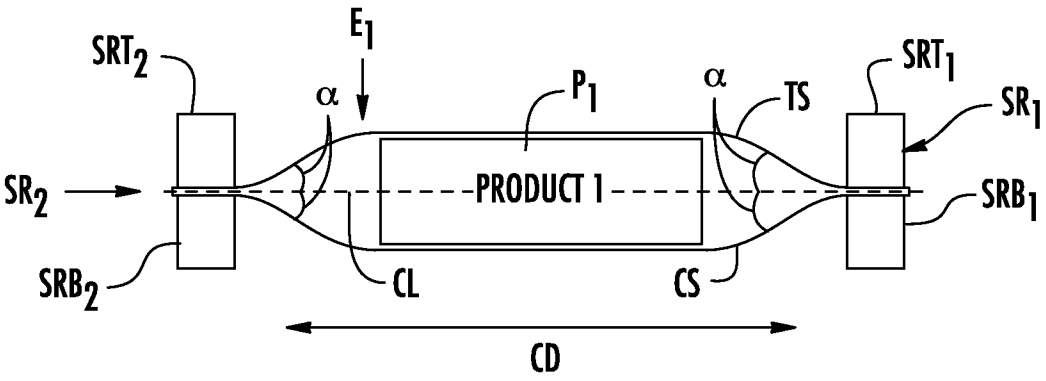
FIG. 1A illustrates a schematic view looking in a machine direction down a travel path of a product being packaged in an embodiment of a package forming system according to the present subject matter as a package is being formed around the product.

Repeat use of reference characters in the present specification and drawings is intended to represent the seam or analogous features or elements of the present subject matter.

DETAILED DESCRIPTION

Reference now will be made to the embodiments of the present subject matter, one or more examples of which are set forth below. Each example is provided by way of an explanation of the present subject matter, not as a limitation. In fact, it will be apparent to those skilled in the art that various modifications and variations can be made in the present subject matter without departing from the scope or spirit of the present subject matter. For instance, features illustrated or described as one embodiment can be used on another embodiment to yield still a further embodiment. It is to be understood by one of ordinary skill in the art that the present discussion is a description of exemplary embodiments only, and is not intended as limiting the broader aspects of the present subject matter, which broader aspects are embodied in exemplary constructions.

Although the terms first, second, right, left, front, back, top, bottom, etc. may be used herein to describe various features, elements, components, regions, layers and/or sections, these features, elements, components, regions, layers and/or sections should not be limited by these terms. These terms are only used to distinguish one feature, element, component, region, layer or section from another feature, element, component, region, layer or section. Thus, a first feature, element, component, region, layer or section discussed below could be termed a second feature, element, component, region, layer or section without departing from the teachings of the disclosure herein.

Similarly, when a feature or element is being described in the present disclosure as "on" or "over" another feature or element, it is to be understood that the features or elements can either be directly contacting each other or have another feature or element between them, unless expressly stated to the contrary. Thus, these terms are simply describing the relative position of the features or elements to each other and do not necessarily mean "on top of" since the relative position above or below depends upon the orientation of the device to the viewer.

Embodiments of the subject matter of the disclosure are described herein with reference to schematic illustrations of embodiments that may be idealized. As such, variations from the shapes and/or positions of features, elements or components within the illustrations as a result of, for example but not limited to, user preferences, manufacturing techniques and/or tolerances are expected. Shapes, sizes and/or positions of features, elements or components illustrated in the figures may also be magnified, minimized, exaggerated, shifted or simplified to facilitate explanation of the subject matter disclosed herein. Thus, the features, elements or components illustrated in the figures are schematic in nature and their shapes and/or positions are not intended to illustrate the precise configuration of the subject matter and are not necessarily intended to limit the scope of the subject matter disclosed herein unless it specifically stated otherwise herein.

It is to be understood that the ranges and limits mentioned herein include all ranges located within the prescribed limits (i.e., subranges). For instance, a range from about 100 to about 200 also includes ranges from 110 to 150, 170 to 190, 153 to 162, and 145.3 to 149.6. Further, a limit of up to about 7 also includes a limit of up to about 5, up to 3, and up to about 4.5, as well as ranges within the limit, such as from about 1 to about 5, and from about 3.2 to about 6.5.

The term "thermoplastic" is used herein to mean any material formed from a polymer which softens and flows when heated; such a polymer may be heated and softened a number of times without suffering any basic alteration in characteristics, provided heating is below the decomposition temperature of the polymer. Examples of thermoplastic polymers include, by way of illustration only, polyolefins, polyesters, polyamides, polyurethanes, acrylic ester polymers and copolymers, polyvinyl chloride, polyvinyl acetate, etc. and copolymers thereof.

"Cohesive" or "cohesives" as used herein means substances that can be applied to a substrate and once cured generally only bond or adhere to itself and not to other non-adhesive materials or substances. Thus, cohesives are substances that, once applied and cured, generally only adhere or bond together to form a seal when a portion of the cohesive come in contact with another portion of the cohesive and generally does not form a seal with other non-adhesive materials or substances with which the cohesive comes into contact. Cohesives, as used herein, are often referred to in the industry as self-seal, cold seal, or cold seal adhesives.

"Adhesive" or "adhesives" as used herein means substances that are used to secure materials, such as substrates, together by binding or adhering to the materials with which they come in contact and resist separation of the materials even under force.

Thus, adhesives are substances that have the ability to secure together non-similar materials or substances by binding and/or adhering to the non-similar materials or substances.

"Pressure-sensitive adhesives" as used herein means adhesives that can have binding or adhesion or enhanced binding or adhesion to non-similar materials or substances when placed under some level of pressure.

"Product" as used herein means one or more physical items that are being packaged on the package forming systems and apparatuses disclosed herein. The term "product" can include, but are not limited to such items as: jewelry, such as rings, bracelets, necklaces, key rings, etc.; utility items, such as knives of various sizes, tools, etc.; electronics, such as cellular phones, tablet devices, televisions, computers, flash drives or other fobs, etc.; personal care items, such as make-up items, moisturizers and creams, razors, brushes, combs, hair dryers, etc.; apparel, such as dresses, pants, skirts, shorts, shirts, belts, shoes, socks, etc.; home furnishings, such as pillows, sheets, fabric coverings, etc.; toys of various sizes; automobile and machinery parts, such as nuts, bolts, bushings, filters, bearings, etc.; tools and hardware, such as screws, nails, screwdrivers, wrenches, pliers, hammers, etc.; and books of various sizes. Thus, the term "product" as used herein can be synonymous and can be used interchangeably with the phrase "one or more products."

"Sheet material" as used herein means one or more items or materials are used to create packages and that can be packed or bundled together or processed in some manner to form a unit for transport.

The present subject matter discloses shipping package forming apparatuses, systems, and related methods. In particular, the present subject matter discloses apparatuses and systems that form and aid in forming packages, such as envelopes, around physical items that are being shipped in the packages. The presently disclosed shipping package forming apparatuses and systems have features that improve the forming of the package around items to be shipped. For example, in some embodiments, the shipping package forming apparatuses can ensure proper placement of the item relative to the sides of the package and can ensure proper alignment of the sides of the sheet material that form the sides of the package so that the sides of the package form a stronger seal. In some embodiments, the shipping package forming apparatuses can ensure proper sealing of packages across the ends of the packages that for stronger seals at the ends of the formed packages. In some embodiments, a more efficient manner of cutting the sheet material to form the ends of the package can be provided.

Figure 1B:
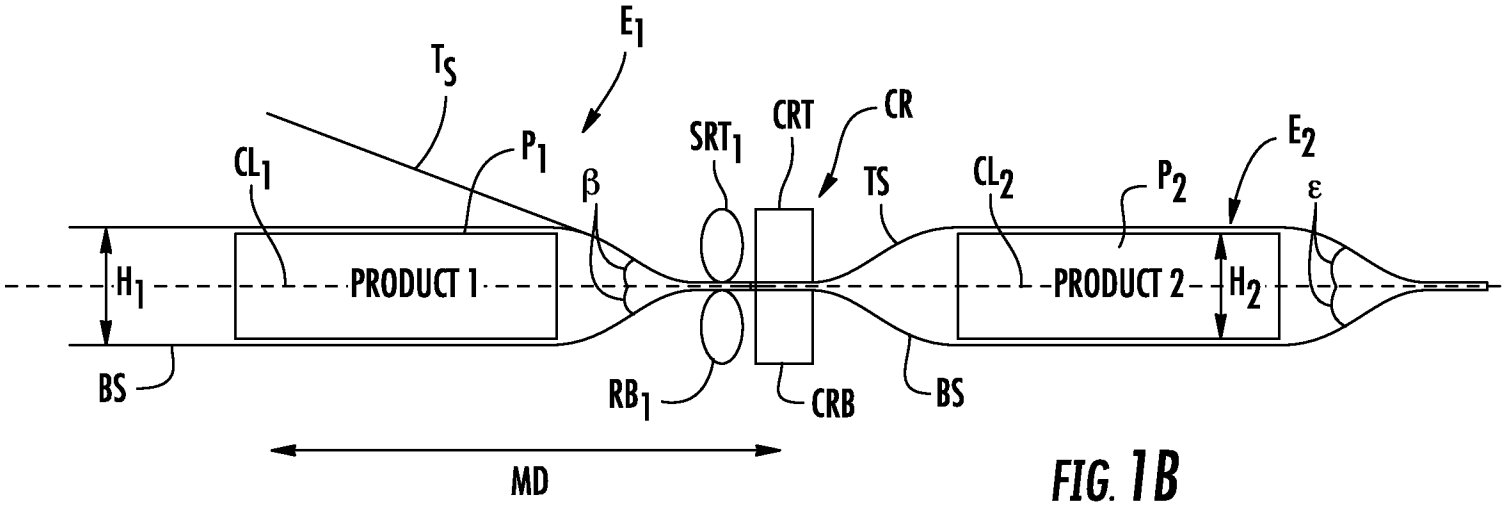
FIG. 1B illustrates a schematic view looking in a cross-machine direction perpendicular to a travel path of a product being packaged in an embodiment of a package forming system according to the present subject matter as a package is being formed around the product.

Referring to FIGS. 1A and 1B, schematics of packages $E_1$ and/or $E_2$ are shown being formed around products $P_1$ and/or $P_2$. The packages $E_1$ and/or $E_2$ are being formed by two sheets being pressed together along the sides as shown in FIG. 1A with packages $E_1$ and $E_2$ being pressed together at either end as shown in FIG. 1B. In particular, each of the packages $E_1$ and/or $E_2$ can be formed by a top sheet material TS and a bottom sheet material BS that can be pressed together by nip rollers as explained further below.

The top and bottom sheet materials TS, BS can be a variety of sheeting materials depending on the desired parameters of packaging. For example, in some embodiments, the top and bottom sheet materials TS, BS can comprise a suitable paper or other wood pulp product. In some embodiments, the top and bottom sheet materials TS, BS can comprise a paper with a cushioned backing secured thereto to for a cushioned interior of the packaging when the top and bottom sheet materials TS, BS are joined together. In some embodiments, the top and bottom sheet materials TS, BS can comprise a nonwoven fabric such as a spunbonded fabric, a meltblown fabric, or the like. In some embodiments, the top and bottom sheet materials TS, BS can comprise a polymeric film. For example, the top and bottom sheet materials TS, BS can comprise a thermoplastic film in some embodiments. The thermoplastic film can comprise a polyolefin film such as a polypropylene film, for instance. Alternatively, the thermoplastic film can comprise at least one of a polyethylene film, a nylon film, or a polyester film. In some embodiments, the top and bottom sheet materials TS, BS can comprise tri-layered films or other multi-layered films, such as nine-layered films.

In some embodiments, to join the top and bottom sheet materials TS, BS together, one or both of the top and bottom sheet materials TS, BS can have an adhesive on an interior side, such as pressure sensitive adhesives. In some embodiments, to join the top and bottom sheet materials TS, BS together, each of the top and bottom sheet materials TS, BS can have an interior side that includes cohesive layer. The cohesives that can be used to form the cohesive layer can have different bond strength depending on the desired parameters of the respective packaging sheet.

For many applications, the cohesives that can be used to form the cohesive layer can have a high bond strength. While, depending on the bond strength, cohesives can slightly tack or stick to other non-adhesive material, cohesives generally only provide a strong seal to themselves. When the cohesive layer coated on the top and bottom sheet materials TS, BS comes into contact with itself or the other sheet material coated with the same cohesive, the bond can result by applying appropriate pressure to the sheet materials with the contacted cohesives. Thus, through the use of the cohesive layer, the top and bottom sheet materials TS, BS can be bonded to itself or to the other sheet material. In some embodiments, the cohesive can comprise a water-based cohesive. In some embodiments, the cohesive can comprise a solvent-based cohesive.

Examples of cohesives that can be used to more or less affect include COSEAL TM and certain ROBOND TM CS, which are supplied by the Dow Chemical Company, and the cohesives used in CRO-NEL® and NYVEL® products, which are produced and sold by Automated Solutions, LLC, to name a few.

FIG. 1B is cross-sectional view taken in a cross-machine direction CD of the package $E_1$ being formed around the product $P_1$ showing the joining of the sides of the package $E_1$ being formed. Once a product $P_1$, which can include one or more items, is to be shipped, the product $P_1$ can be placed on the bottom sheet material BS within a package forming system or apparatus (not shown in FIGS. 1A and 1B). The bottom sheet material BS can act as a conveyor through the package forming system or apparatus. The top sheet material TS and the bottom sheet material BS can converge between the nips of two sets of rollers $SR_1$ and $SR_2$ on either side. The sets of rollers $SR_1$ and $SR_2$ can comprise pressurized or weighted rollers that can create a great enough pressure to bond the cohesives on the top and bottom sheet materials TS, BS that are facing each other. The first set of rollers $SR_1$ can include a top roller $SRT_1$ and a bottom roller $SRB_1$ on a first side. The second set of rollers $SR_2$ can include a top roller $SRT_2$ and a bottom roller $SRB_2$ on a second side. A first side of the top sheet material TS and a first side of the bottom sheet material BS converge together and run between the nip of the top roller $SRT_1$ and bottom roller $SRB_1$ to join the top sheet material TS and the bottom sheet material BS together on the first side. Similarly, a second side of the top sheet material TS and a second side of the bottom sheet material BS converge together and run between the nip of the top roller $SRT_2$ and bottom roller $SRB_2$ to join the top sheet material TS and the bottom sheet material BS together on the second side.

Ideally, it is desirable to have the product $P_1$ align with the sets of rollers $SR_1$ and $SR_2$ with the product $P_1$ so that a center line CL (shown in dashed lines) of the product $P_1$ can pass through, or proximal to the aligned nips of the sets of rollers SR1 and SR2. In this manner, the sides of the top and bottom sheet materials TS, BS can more closely align with each other to provide a better seal on the sides of the package. For example, it can be desirable to have the angles formed between the top sheet material TS and the centerline CL and between the bottom sheet material BS and the centerline CL to be the same or substantially similar.

Similarly, a cross seal device, such as a set of rollers CR can be used to seal the ends of the packages $E_1$ and $E_2$ as the respective package is being formed as shown in FIG. 1B. The set of rollers CR can comprise pressurized or weighted rollers that can create a great enough pressure to bond the cohesives on the top and bottom sheet materials TS, BS that are facing each other to form the ends of the respective packages $E_1$ and $E_2$. The set of rollers CR can run back and forward in the cross-machine direction as the product being packaged passes through the package forming system to form a first end and a second end of each package $E_1$ and $E_2$. The first set of rollers CR can include a top roller CRT and bottom roller CRB that run back and forth from one side of the forming apparatus to other across the pathway of the top and bottom sheet materials TS, BS. As shown in the schematic drawing of FIG. 1B, as the second package $E_2$ passes through the side rollers $SR_1$ such that an end of the product $P_2$ passes the side rollers $SR_1$ and enough of the top and bottom sheet materials TS, BS have passed through to allow a back end of the second package $E_2$ to be closed, the first set of rollers CR which can operate on a track can run across the package pathway with the top and bottom sheet materials TS, BS passing between the nip of set of rollers CR such that a seal is made between the top and bottom sheet materials TS, BS. This sealed portion between the top and bottom sheet materials TS, BS can form a second end of the second package $E_2$ as well as a first end of the first package $E_1$ being formed. In particular, the cross sealed portion can be cut or perforated by a cutting device to form the second end of the second package $E_2$ and the first end of the first package $E_1$ being formed. Such cuts or perforations can be performed after the end sealed portion is formed or during the formation of the end sealed portion. Similarly, instead of a set of rollers CR, a singular pressurized roller can form a nip with a portion of the shipping package forming system, such as an anvil bar or a portion of the frame, between which the top and bottom sheet materials TS, BS can pass.

As with the formation of the sides of the packages $E_1$ and $E_2$, the length of the top and bottom sheet materials TS, BS between the respective ends of the products $P_1$ and $P_2$ and the respective front end and the back end of the respective sides of the packages $E_1$ and $E_2$ is such that the front end and the back end of the respective sides of the packages $E_1$ and $E_2$ can at least proximately align with center lines $CL_1$ and $CL_2$ of the respective packages $E_1$ and $E_2$. In some embodiments, each of the ends of the packages $E_1$ and $E_2$ can be about an inch thick. With the alignment with the center lines $CL_1$ and $CL_2$ of the respective packages $E_1$ and $E_2$, the closure angles between the centerline and the top and bottom sheet materials TS, BS can be approximately the same. For example, the closure angle β between the top sheet material TS and the centerline $CL_1$ on an end of the package $E_1$ being formed can be equal to or substantially similar to as the closure angle β between the bottom sheet material BS and the centerline $CL_1$ on the end of the package $E_1$ being formed. Similarly, the closure angle ε between the top sheet material TS and the centerline $CL_1$ on either end of the second package $E_2$ can be equal to or substantially the same as the closure angles between the bottom sheet material BS and the centerline $CL_1$ on either end of the second package $E_2$. As shown in FIGS. 1A and 1B, variations in the height of the product being shipped will likely often occur. As shown, product $P_2$ has a greater height than a height of the product $P_1$. Thus, to accommodate the alignment of the sealed side and end portions of the package with the centerline of the products, a portion of the shipping package forming system can be adjustable. For example, the shipping package forming system can have an adjustable table portion over which the bottom sheet material BS can run and on which the product (on top of the bottom sheet material BS) can be placed. Such a table portion can allow for the alignment of the nips between the various rollers (and, in some embodiments, between rollers and frame portion) to be aligned with a centerline line of each product to improve the sealing of the ends and sides of the respective packages.

Figure 2:
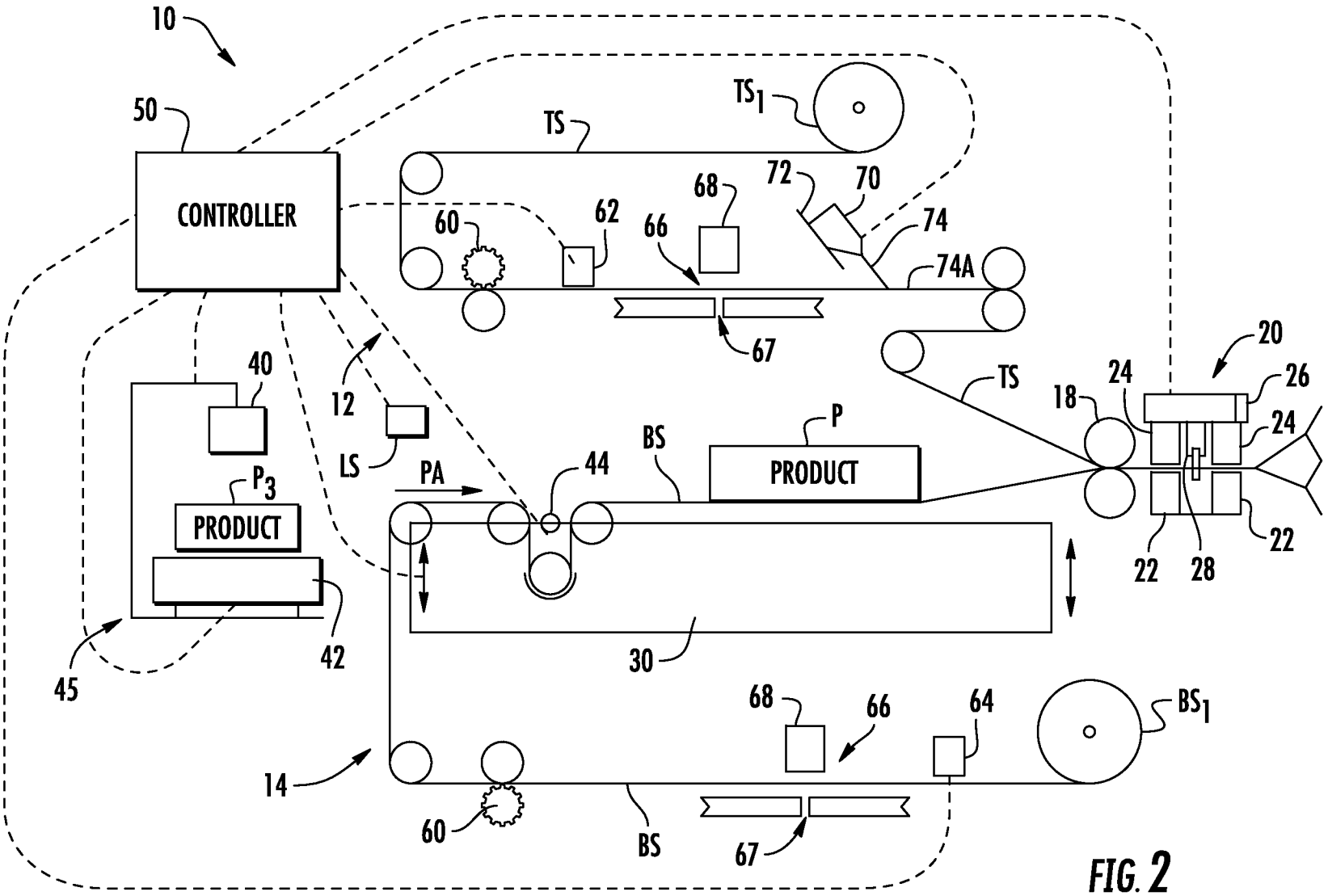
FIG. 2 illustrates a schematic view of an embodiment of a package forming system according to the present subject matter.

For example, referring to FIG. 2, a schematic of an embodiment of a shipping package forming system, also known as a former, generally designated 10, is provided. The package forming system 10 can comprise a top sheet material guide system 12 and a bottom sheet material guide system 14. Each of the top and bottom sheet material guide systems 12 and 14 can each comprise one or more tension rollers and/or drive rollers for providing top and bottom sheet materials TS, BS under tension. For example, a roll $TS_1$ of the top sheet material TS can be installed into the top sheet material guide system 12 and the top sheet material TS can be properly placed around the tension rollers and/or between the driver rollers. Similarly, a roll $BS_1$ of the bottom sheet material BS can be installed into the bottom sheet material guide system 14 and the bottom sheet material BS can be properly placed around the tension rollers and between the driver rollers. The sides of the top and bottom sheet materials TS, BS can be secured between the nips of two sets of nip rollers 18 (of which only one set is shown in FIG. 2, but similar to the sets of rollers $SR_1$ and $SR_2$ shown in FIG. 1A) on either side of the pathway of the top and bottom sheet materials TS, BS. The sets of rollers 18 can be pressurized or weighted to create a pressure high enough to seal the sides of the package being formed by the top and bottom sheet materials TS, BS. In some embodiments, the nip rollers 18 can operate as driver rollers for the top and bottom sheet material guide systems 12 and 14 and can pull the top and bottom sheet materials TS, BS along the product pathway.

The package forming system 10 can also comprise a cross seal device 20 for forming ends of the package being formed. The cross seal device 20 can be a variety of devices that can form ends of packages being formed. In some embodiments, the cross seal device 20 can comprise sealing bar and knife which extends across the product pathway. The knife can pushed straight downward against the sealing bar under pressure so that the end of the package is both sealed and cut. In some embodiments, as the embodiment shown in FIG. 2, the cross seal device 20 can comprise an anvil 22 that can be engaged by one or more rollers 24 carried by a carriage 26. The carriage 26 can be operated along a track (not shown) transverse to the pathway of the top and bottom sheet materials TS, BS. The rollers 24 can be placed under pressure so as to create a pressured engagement with anvil 22 as the rollers 24 roll across the top and bottom sheet materials TS, BS transverse to the pathway of the top and bottom sheet materials TS, BS. Due to cohesive on the interior side of the top and bottom sheet materials TS, BS, the top and bottom sheet materials TS, BS can be sealed together to form an end of package for the product as the rollers 24 roll over the top and bottom sheet materials TS, BS. When engaged with the anvil 22, the transverse movement of the rollers 24 can form a first end of a package being formed and a second end of the package being finished as the rollers 24 roll across the top and bottom sheet materials TS, BS. The carriage 26 can include one or more blades 28 that can cut the joined top and bottom sheet materials TS, BS to form the ends of the respective adjacent packages being formed in the system 10.

The package forming system 10 can also comprise a support table 30 that can be used to support a portion of the bottom sheet material BS and the product P that is placed upon the bottom sheet material BS and is being conveyed by the bottom sheet material BS. The support table 30 can include some of the guide system 14 of the bottom sheet material BS. The support table 30 can be automatically or semi-automatically adjusted upwardly or downwardly based on the centerline of the product P being packaged to align the centerline of the product P with the nips of the sets of rollers 18 as well as the nip created by the roller 24 and anvil 22 when the rollers are put under pressure.

In some embodiments, the package forming system 10 can comprise a height sensor 40 that can measure the height of the product P being processed. Additionally, the package forming system 10 can comprise in some embodiments, a weight sensor 42, such as a scale to measure the weight of the product or the package that is formed around the product and contains the product. For example, in some embodiments, a weight sensor can be positioned after the packaged is formed. Alternatively, the package that is formed around and that contains the product can be weighted in a later process. Further, in some embodiments, the package forming system 10 can include one or more sensors 44 that can measure distances related to the product P. In some embodiments, the sensors 44 can comprise length sensors that are used to measure the length of a product. In some embodiments, instead of measuring the length of the product, one or more sensors 44, such as photo eyes, can be used to measure the presence of a product on the pathway and can also measure the distance from a start position once the product is placed on the pathway to a leading edge of the product once the bottom sheet material and product are moved forward. This measurement by sensors 44 can be sent to the controller 50 and can be used to determine the amount of top and bottom sheet materials TS, BS needed to form the rear portion of the package and the amount of adjustment for the table 30 in some embodiments.

As another example, in some embodiments, a weigh station 45 can be provided on which a product $P_3$ to be packaged can be placed before being placed on the conveying bottom sheet material BS on the support table 30. The weigh station 45 can include the scale 42 for measuring the weight of the product to be shipped. Above the scale 42, the height sensor 40 can be placed to measure the height of the product $P_3$ as the product $P_3$ is being weighed.

In embodiments that include a sensor 44, the sensor 44 can operate as a length sensor and can be placed along the pathway of product within the package forming system 10 as the bottom sheet material BS moves the product P along the pathway. In some embodiments, the sensor 44 can be used to measure other distances beside the length of the product P. For example, in some embodiments, the sensor 44 can be secured to the support table 30 with guide rollers/tensioning rollers secured to the table 30 that guide the bottom sheet material BS around the sensor 44 in such a manner that the sensor 44 has an unobstructed view of the product P as it passes above the length sensor 44 while, at the same time, not interfering with the ability of the bottom sheet material BS to convey the product P within the package forming system 10.

The package forming system 10 can further comprise a controller 50 that can be in communication with drive system (not shown) that can power the package forming system 10 to control the operation of the package forming system 10. Further, for embodiments that employ one or more height, weight, and/or length sensors, such as sensors 40, 42, and 44, the controller 50 can be in communication with one or more of such sensors 40, 42, 44. The controller 50 can also be in communication with the driver system (not shown) that can be used to adjust the support table 30 upwardly or downwardly. The controller 50 can comprise any capable processing unit, such as a programmable logic controller ("PLC"), a desktop computer, a laptop computer, a mini computer, or the like, including combinations thereof. The controller 50 can process the information provided by the sensors mentioned above as well as other sensors and information that the controller 50 can use to effectively operate the package forming system 10. For example, in some embodiments, one or more sensors 44, such as photo eyes, can be provided that can be used to measure the presence of a product on the pathway and can also measure the distance from a start position once the product is placed on the pathway to the leading edge of the product once the bottom sheet material and product are moved forward. This measurement by sensor 44 can be sent to the controller 50 and can be used to determine the amount of adjustment for the table 30 in some embodiments.

Regarding the adjustment of the table 30, the controller 50 can obtain and process information from the sensors, such as height sensor 40 or distance measurements from the sensor 44, to determine whether the table 30 should be moved upward or downward to position the table 30 such that the centerline of the product aligns properly with the nips of the set of side rollers 18 and the roller 24 and the anvil 22. The controller 50 can then communicate with a drive system (not shown) that moves the table 30 up and down to move the table 30 to the desired position at the appropriate time once the product that was measured is placed on the bottom sheet material BS and the table 30.

Instead of using a height sensor and/or a length sensor, some embodiments can employ one or more sensors 44, such as photo eyes, that measure the distance the product moves after placement of the product by an operator on the bottom sheet material BS along the pathway of the package forming system 10. The controller 50 can use this measured distance to determine the length of the top and bottom sheet materials TS and BS at the rear of the package and to determine the amount of adjustment that is needed for the table 30 to produce the package.

As described above, when packaging a product with the package forming system 10, it is desirable to have the seal on the side of the package in the center of the package top to bottom. This makes the top and bottom sheet materials TS and BS the same width with both side edges equal. One method for determining the height or thickness of the product to be packaged is for an operator to examine the package and estimate its thickness. The adjustable table 30 can have a placement gate attached, as explained in more detail below, and one or more laser guides LS can project one or more laser lines onto the bottom sheet material BS on the table 30. For example, the laser guide LS can project three (3) laser lines in front of the placement gate. The distance between the laser lines and the between the forward most laser line and the placement gate can comprise the same distance or different distances. In some embodiments, these distances can be permanently set. In some embodiments, these distances can be varied depending on the types of products being packaged. For example, in some embodiments, these three lines can each be about one (1) inch apart and the first line closest to the placement gate can be about one (1) inch from the placement gate. The operator places the material to be packaged so that its front edge is located at the approximate thickness from the gate. The laser lines being about one (1) inch apart gives the operator an opportunity to place the products to be packaged in the appropriate place. Additionally, there can be a laser line projected down the center of the table 30 to assist the operator in placing the material in the middle of the table 30. The operator can then press a start button in communication with the controller 50 and the product is advanced on the bottom sheet material BS along the pathway of the package forming system 10. The distance the conveying bottom sheet material BS moves before the product to be packaged encounters the sensor 44, such as the view path of photo eyes, determines the height or thickness of the package estimated by the operator and the table can be automatically adjusted so that the center of the package is on the center of the nip rollers 18 that seal the side of the package.

The distance between the sensor 44 and the cross seal device 20 that separate one package from the next package is a fixed distance that tells the controller 50 when to stop and cut the package in question. As the product continues to advance through the package forming system 10, the sensor 44 can identify the back edge of the package. To get the correct amount of top and bottom sheet materials TS, BS for the package to be formed, the controller 50 adds to the back of the package the same length of bottom sheet material BS as measured from the front of the product after the operator places it on the bottom sheet material BS along the pathway of the package forming system 10 to the position where the sensor 44 takes the reading of the front of the product. This represents the cut line for the back of the package and the front of the next product being packaged.

Also based on the measurement of the table 30 moves up and down to the center line of each of the products being packaged just before each package is about to advance through the side seal nip rollers. Using this method, the controller 50 does not need the length of the product to determine the length of material needed for the package but only the leading and trailing edges of the package.

Referring to FIGS. 3A-6, a more detailed embodiment of a package forming system, also known as a former, generally designated 100, is provided. As shown in FIGS. 3A-3F, the package forming system 100 can comprise a top sheet material guide system 102 and a bottom sheet material guide system 104 that feed top and bottom sheet materials TS, BS into the package forming system 100 to form packaging around a product. The package forming system 100 can also comprise two sets of nip rollers 108 on either side of a pathway PA to seal the sides of a package being formed and a cross seal device 130 that can be used to seal the ends of the packages being formed in the system 100. Additionally, the package forming system 100 can comprise an adjustable table 110 that can automatically adjust the height position of the product to be packaged relative to the sets of nip rollers 108 and the cross seal device 130 so that the top and bottom sheet materials TS, BS being fed into the package forming system 100 by the top and bottom sheet material guide systems 102 and 104 can form stronger and better seals along the sides and ends of a package around a product being packaged in the package forming system 100. The package forming system 100 can further comprise a controller 150 that can be used to control the operation of the package forming system 100 and the different systems, components, and devices that comprise the package forming system 100, including the adjustment of the adjustable table 110 and the nip rollers 108. The package forming system 100 and its different systems, components and devices will be explained in more detail below.

The package forming system 100 can also comprise a frame 106 for supporting the sheet material guide systems 102, 104 and other components of the package forming system 100, including the adjustable support table 110. The frame 106 can comprise outer frame side panels 106A, 106B as well as a plurality of legs 106C that can be directly or indirectly secured to the side panels 106A, 106B. In some embodiments, the frame 106 can also comprise one or more safety guards 106D that can cover components of the package forming system 100 to protect the respective components of the package forming system 100 and reduce the possibility of injury to an operator of the package forming system 100.

The top and bottom sheet material guide systems 102 and 104 can each comprise one or more tension rollers and/or drive rollers for providing the top and bottom sheet materials TS, BS under tension. For example, a roll $TS_1$ of the top sheet material TS can be installed into the top sheet material guide system 102 and the top sheet material TS can be properly placed around the tension rollers and/or between the driver rollers. Similarly, a roll $BS_1$ of the bottom sheet material BS can be installed into the bottom sheet material guide system 104 and the bottom sheet material BS can be properly placed around the tension rollers and/or between the driver rollers as described further below. In some embodiments, the nip rollers 108 can operate as driver rollers for the top and bottom sheet material guide systems 102 and 104 and can pull the top and bottom sheet materials TS, BS along the product pathway as explained further below. Other drive rollers (not shown) may be used in additionally or alternatively.

Figure 3A:
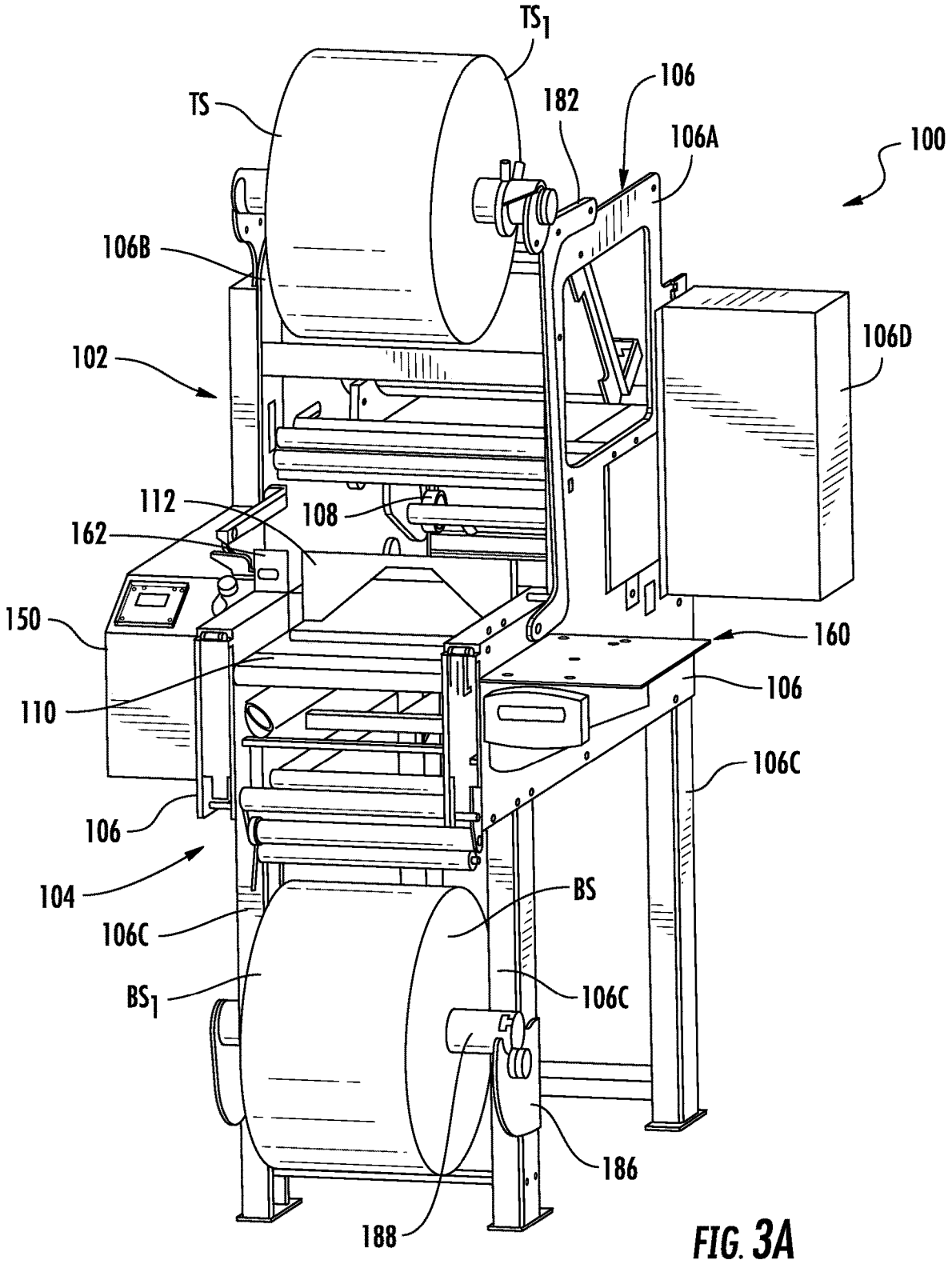
FIG. 3A illustrates a front top perspective view of another embodiment of a package forming system according to the present subject matter.
Figure 3B:
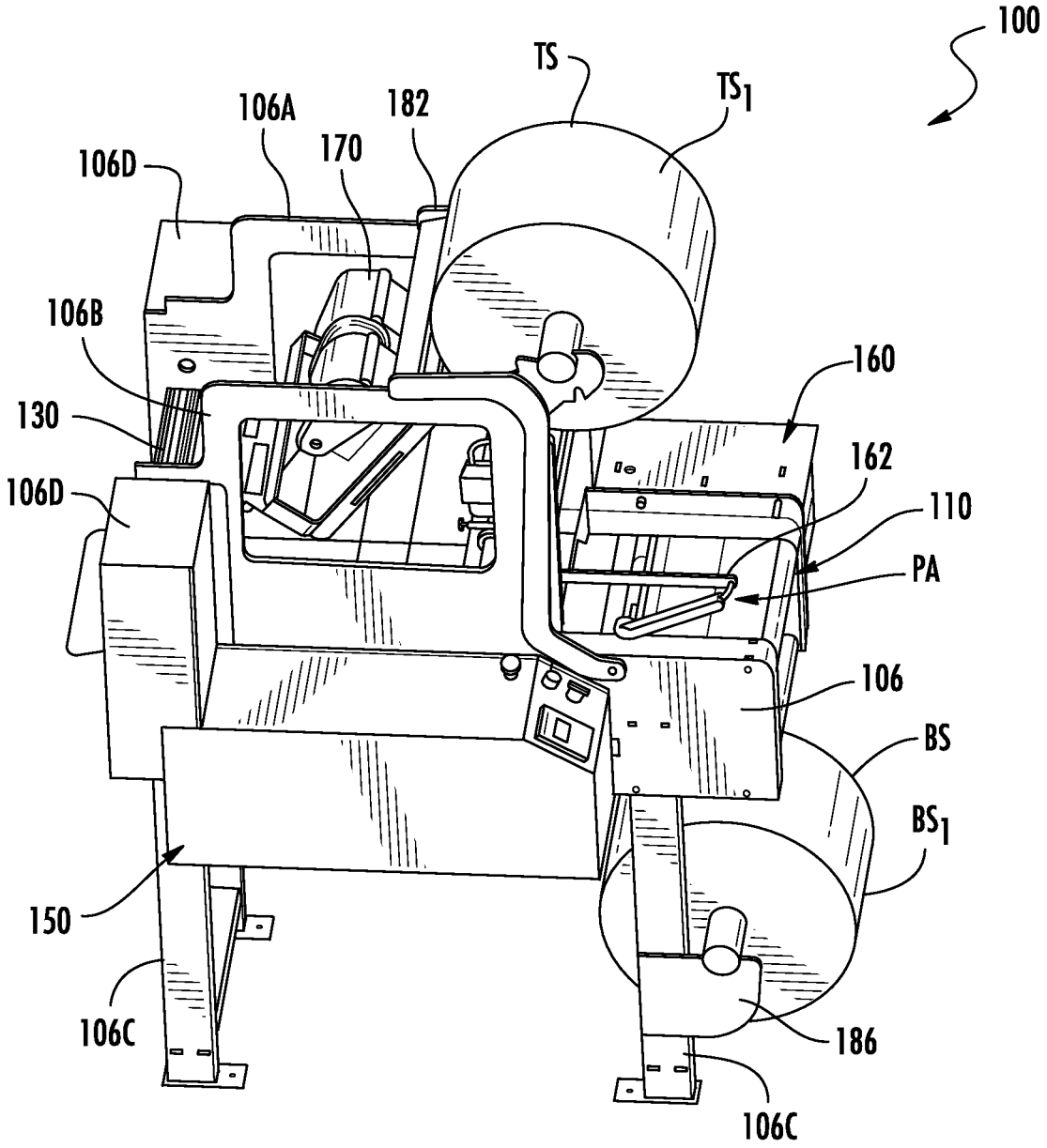
FIG. 3B illustrates a side top perspective view of the embodiment of the package forming system according to FIG. 3A.
Figure 3C:
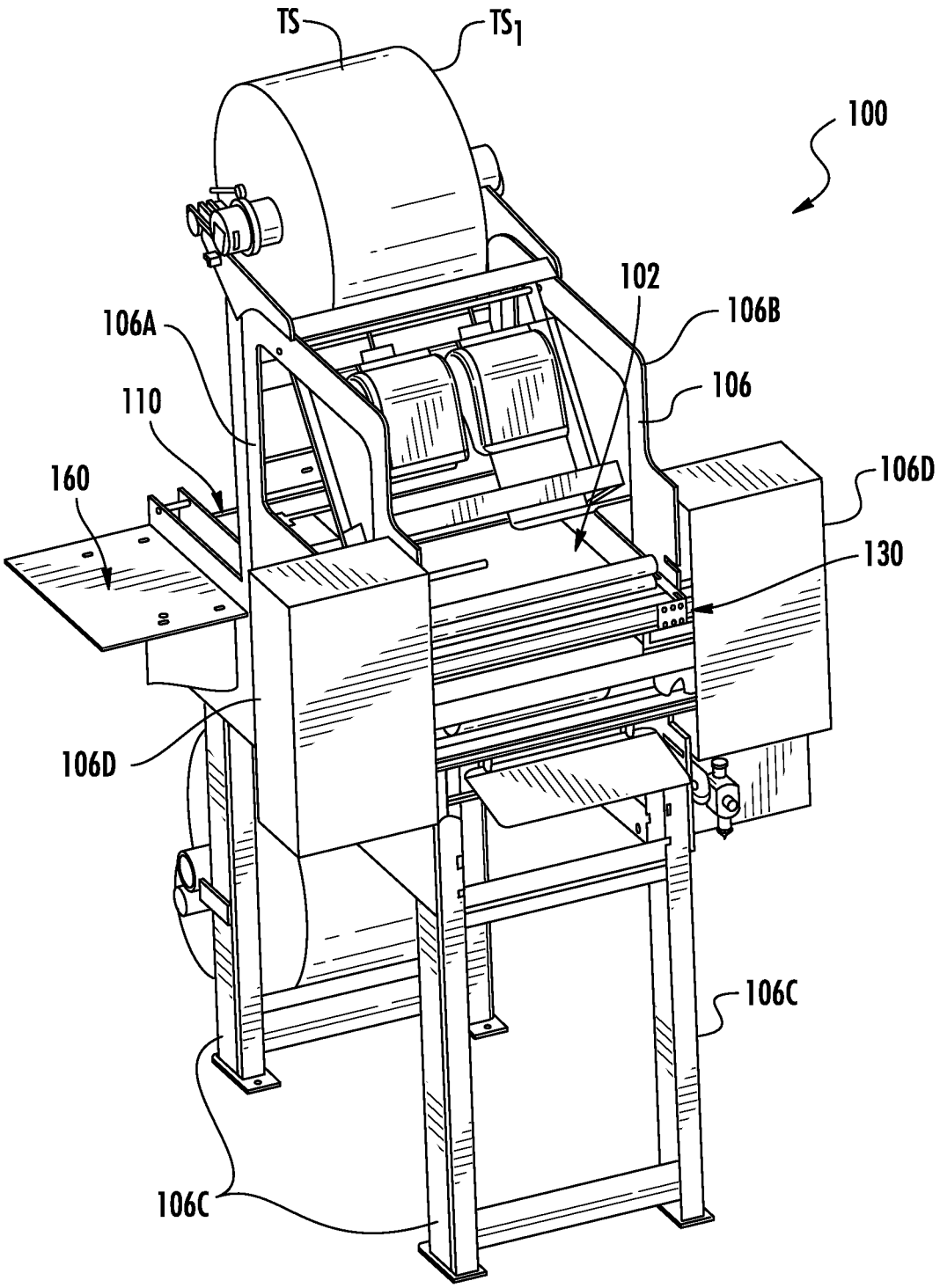
FIG. 3C illustrates a rear top perspective view of the embodiment of the package forming system according to FIG. 3A.
Figure 3D:
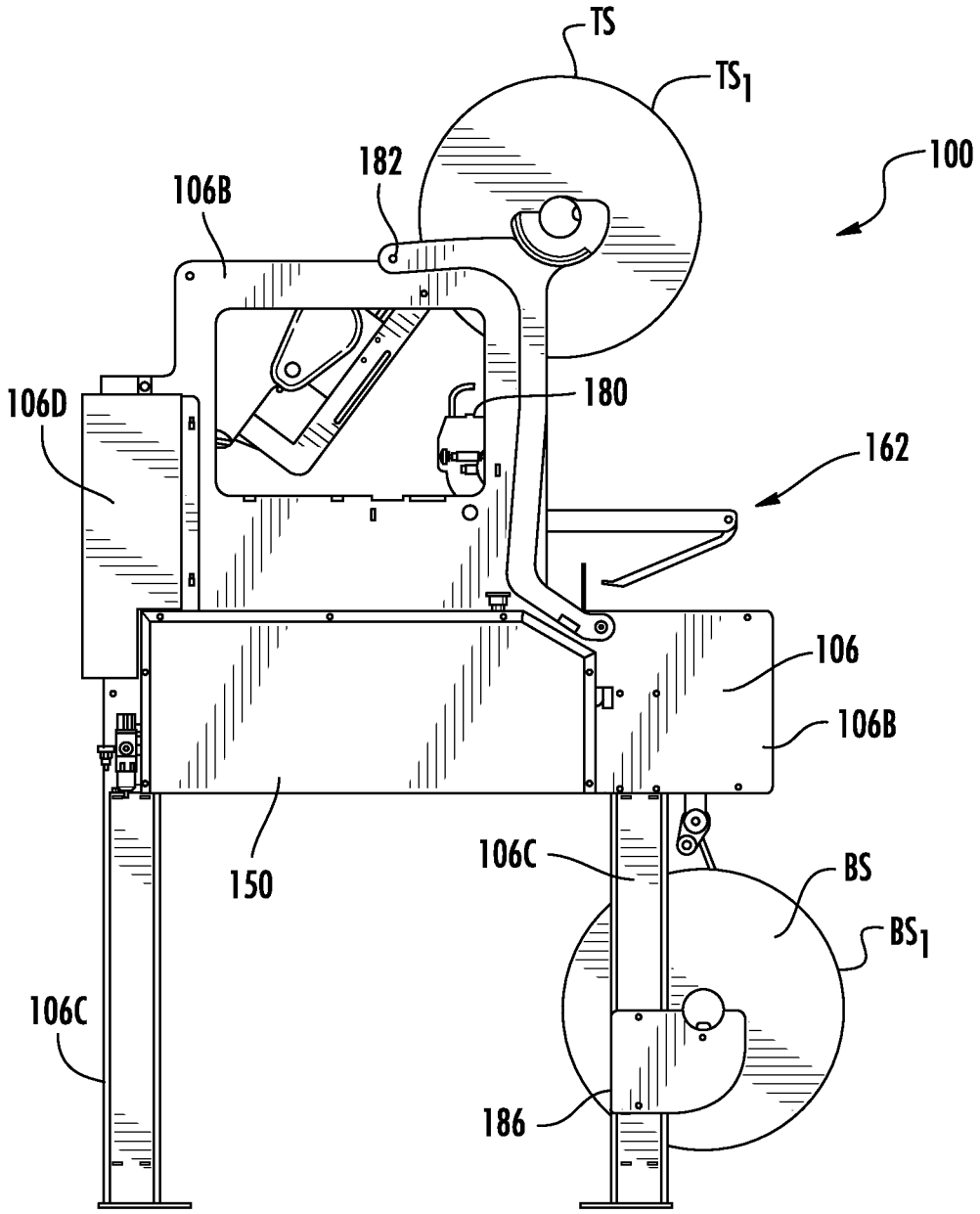
FIG. 3D illustrates a side view of the embodiment of the package forming system according to FIG. 3A.
Figure 3E:
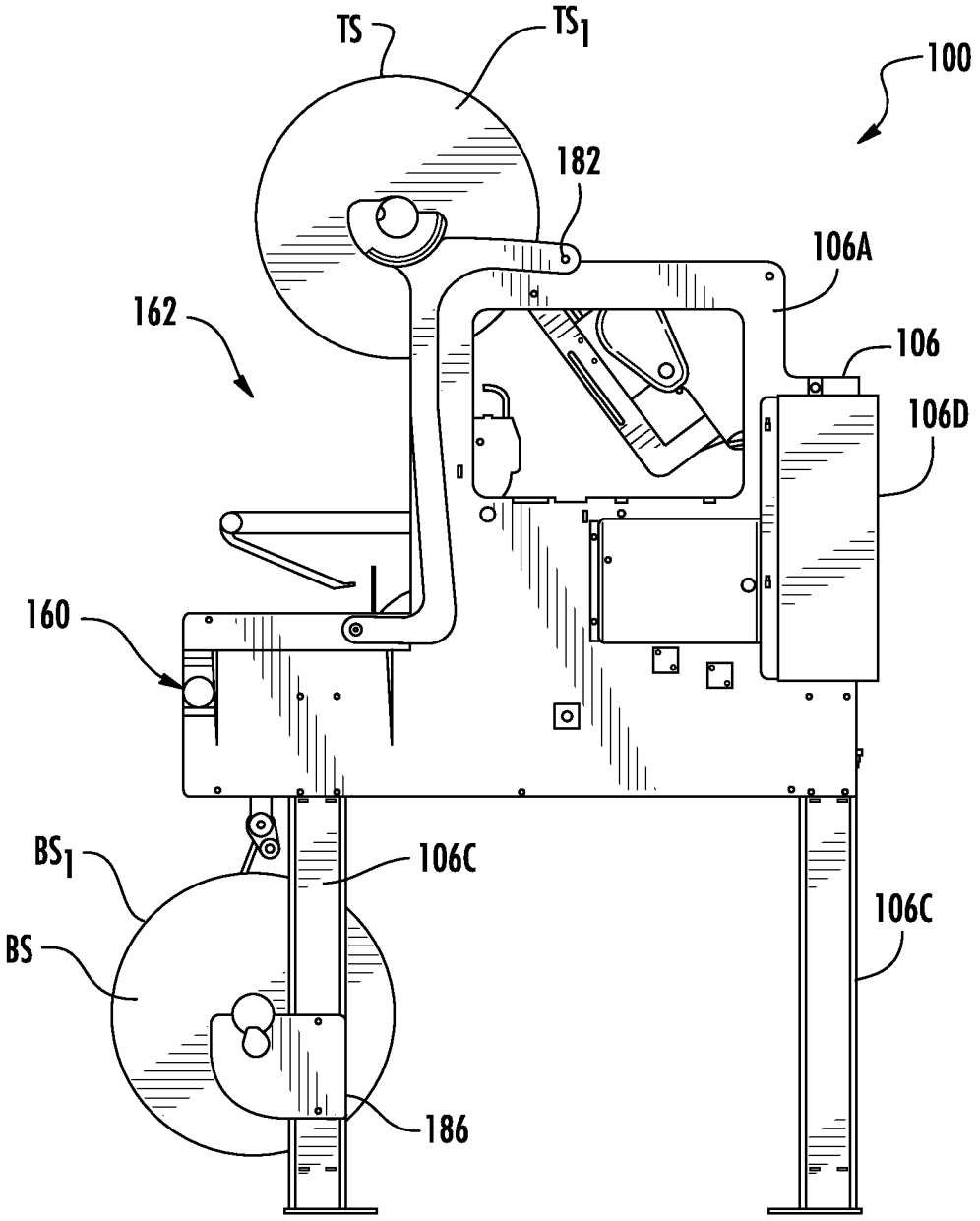
FIG. 3E illustrates an opposing side view of the embodiment of the package forming system according to FIG. 3A to the view in FIG. 3D.
Figure 3F:
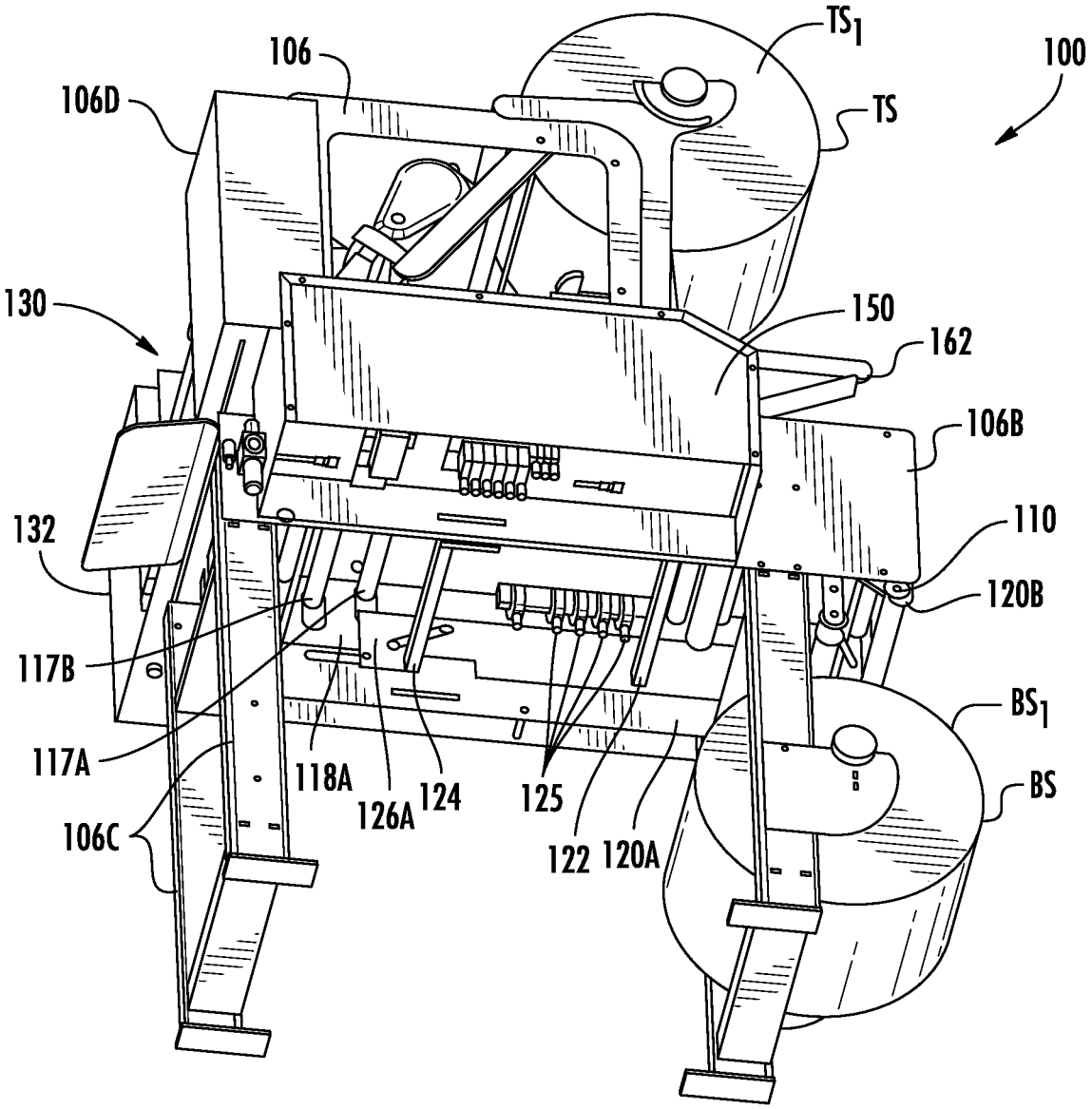
FIG. 3F illustrates a side bottom perspective view of the embodiment of the package forming system according to FIG. 3A.
Figure 3G:
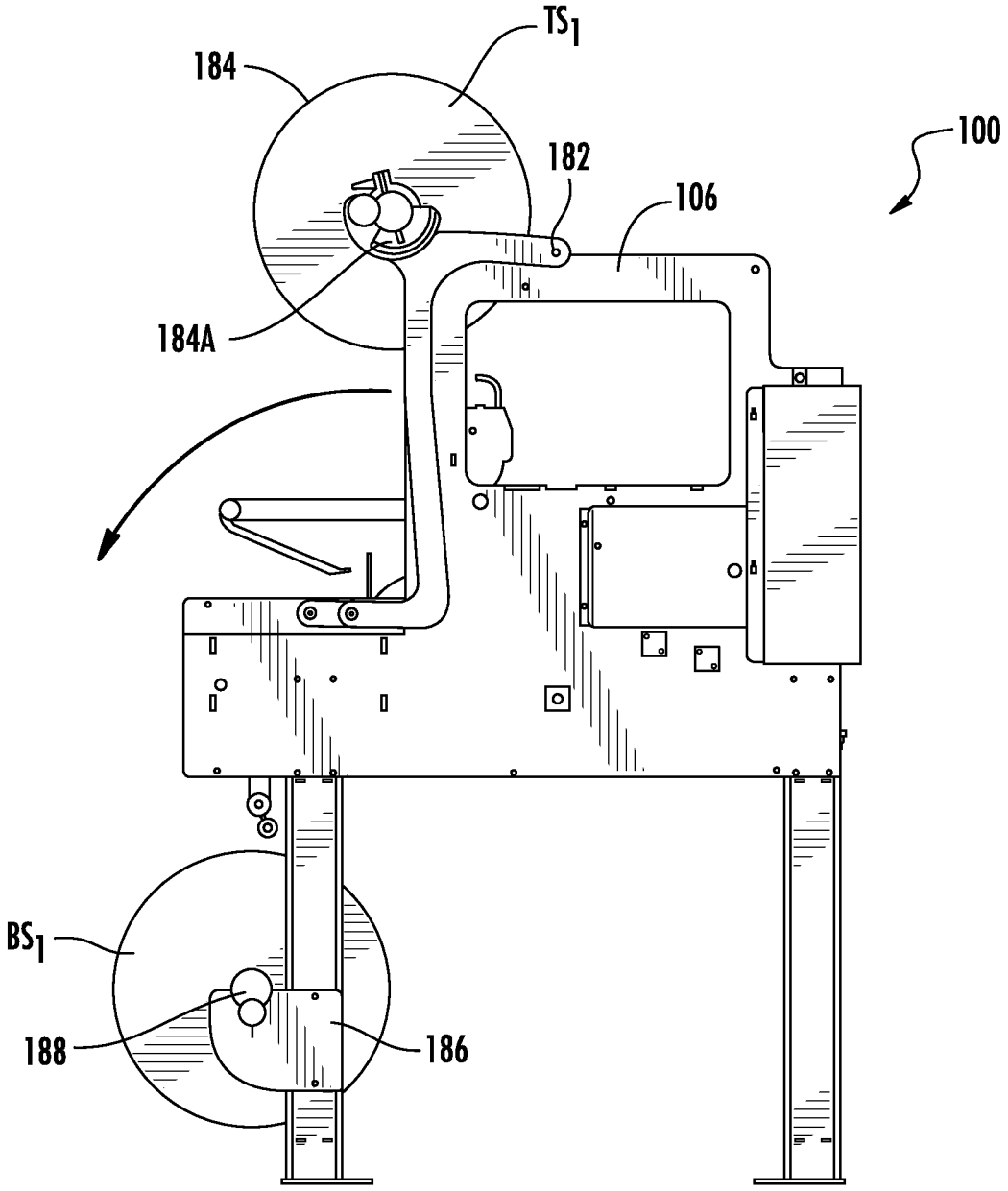
FIG. 3G illustrates a side view of the embodiment of the package forming system according to FIG. 3A with an embodiment of top rolling positioning arms for holding a roll of sheet material in an upper run position.
Figure 3H:
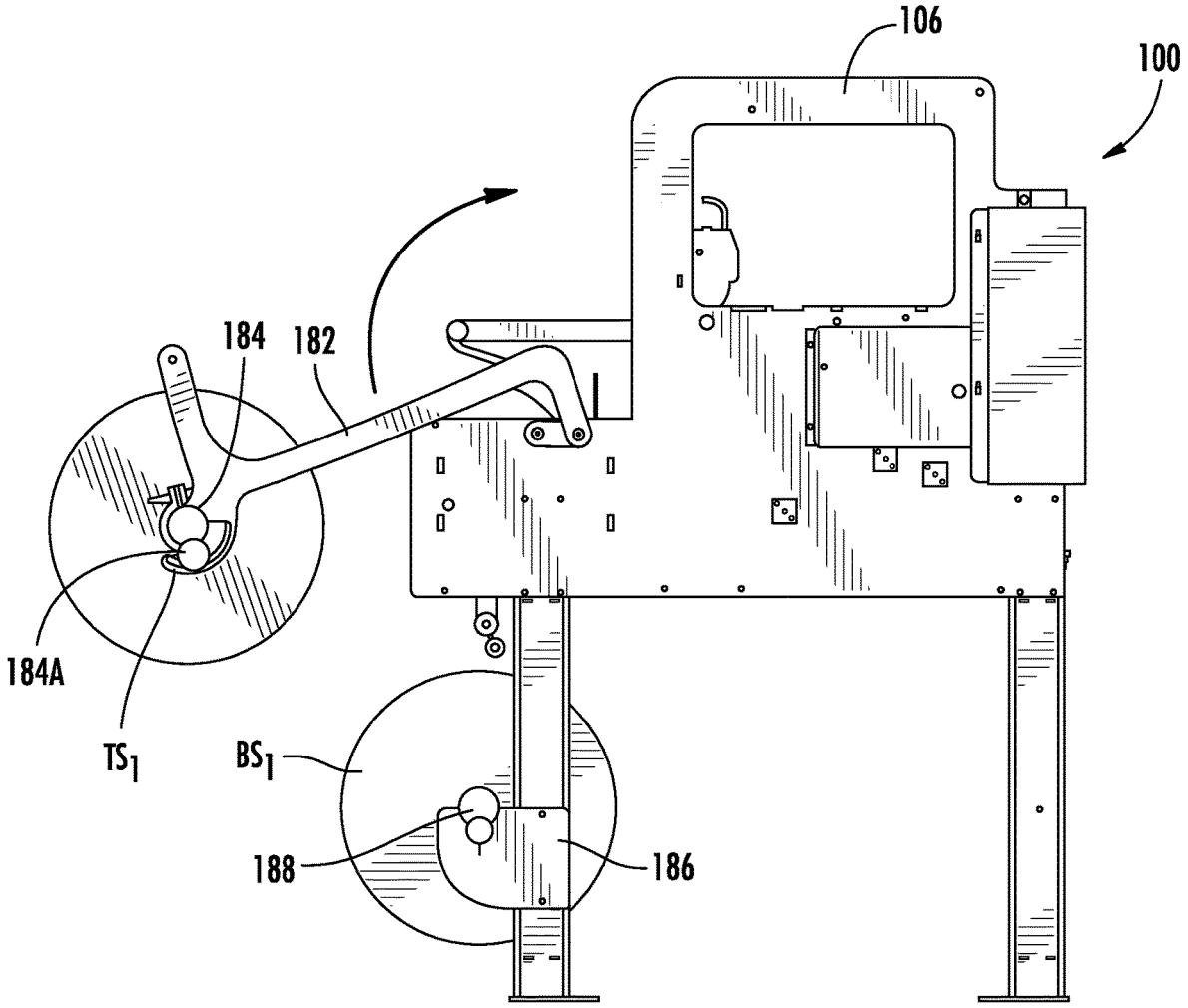
FIG. 3H illustrates a side view of the embodiment of the package forming system according to FIG. 3A with the top rolling positioning arms for holding a roll of sheet material show in FIG. 3G in a lowered loading position.

In particular in some embodiments as shown in FIGS. 3G and 3H, the top sheet material guide system 102 can comprise a roll holding member that can include roll positioning arms 182 secured to the frame 106 that can have an axle lock 184A for engaging an axle 184 on which the roll $TS_1$ of the top sheet material TS can be placed. Similarly, the bottom sheet material guide system 104 can comprise a roll holding member that can include roll positioning arms 186 secured to the frame 106 that can engage an axle 188 on which the roll BS, of the bottom sheet material BS can be placed. The axles 184 and 188 can aid in maintaining a proper tension in the top and bottom sheet materials TS, BS as the top and bottom sheet materials TS, BS travel within the package forming system 100 and can prevent over-rotation of the rolls $TS_1$, $BS_1$.

Figure 5A:
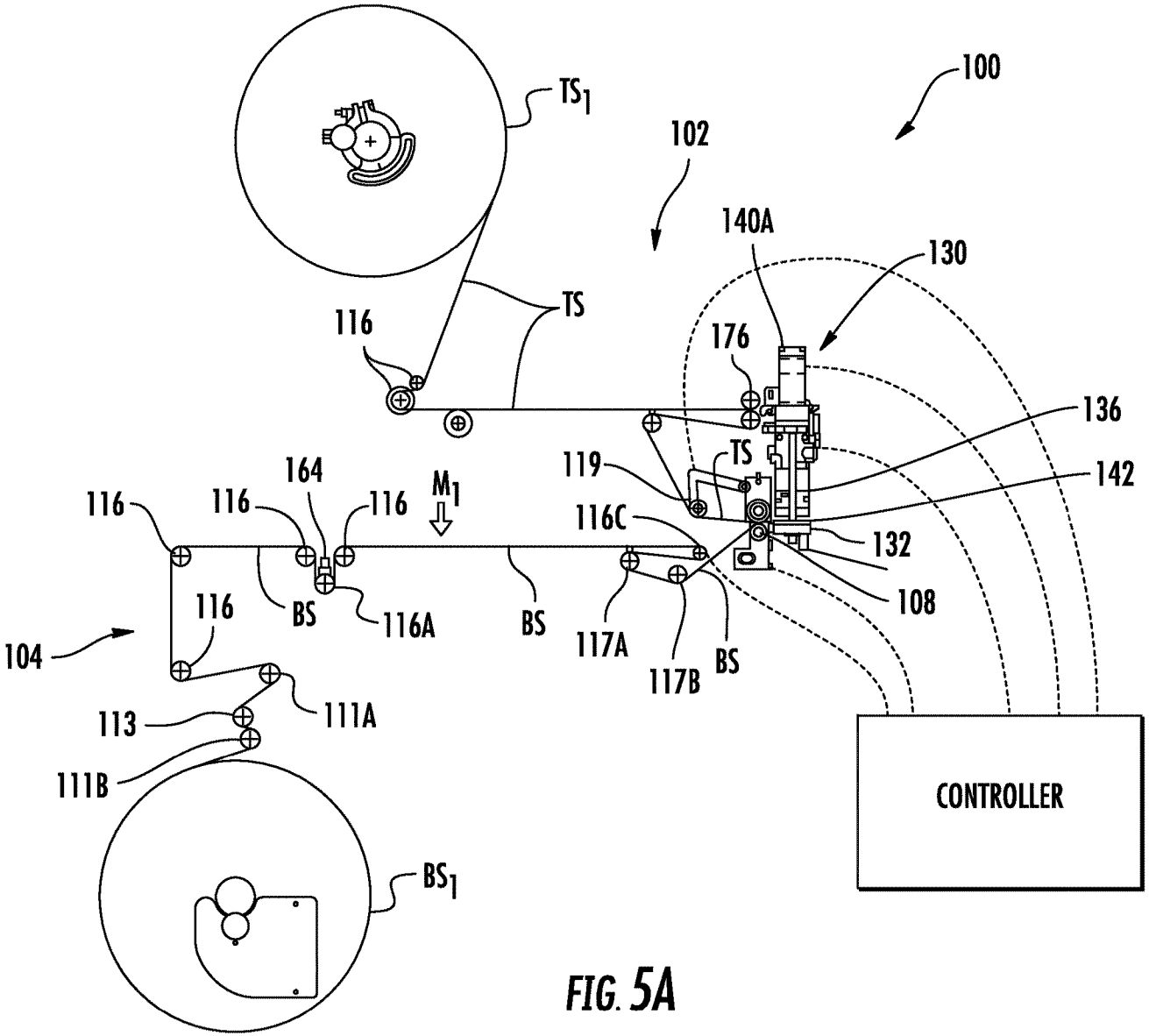
FIG. 5A illustrates a schematic view of an embodiment of a package forming system according to the present subject matter with an embodiment of a guide tension roller secured to an adjustable table (not shown) in a lower position.
Figure 5B:
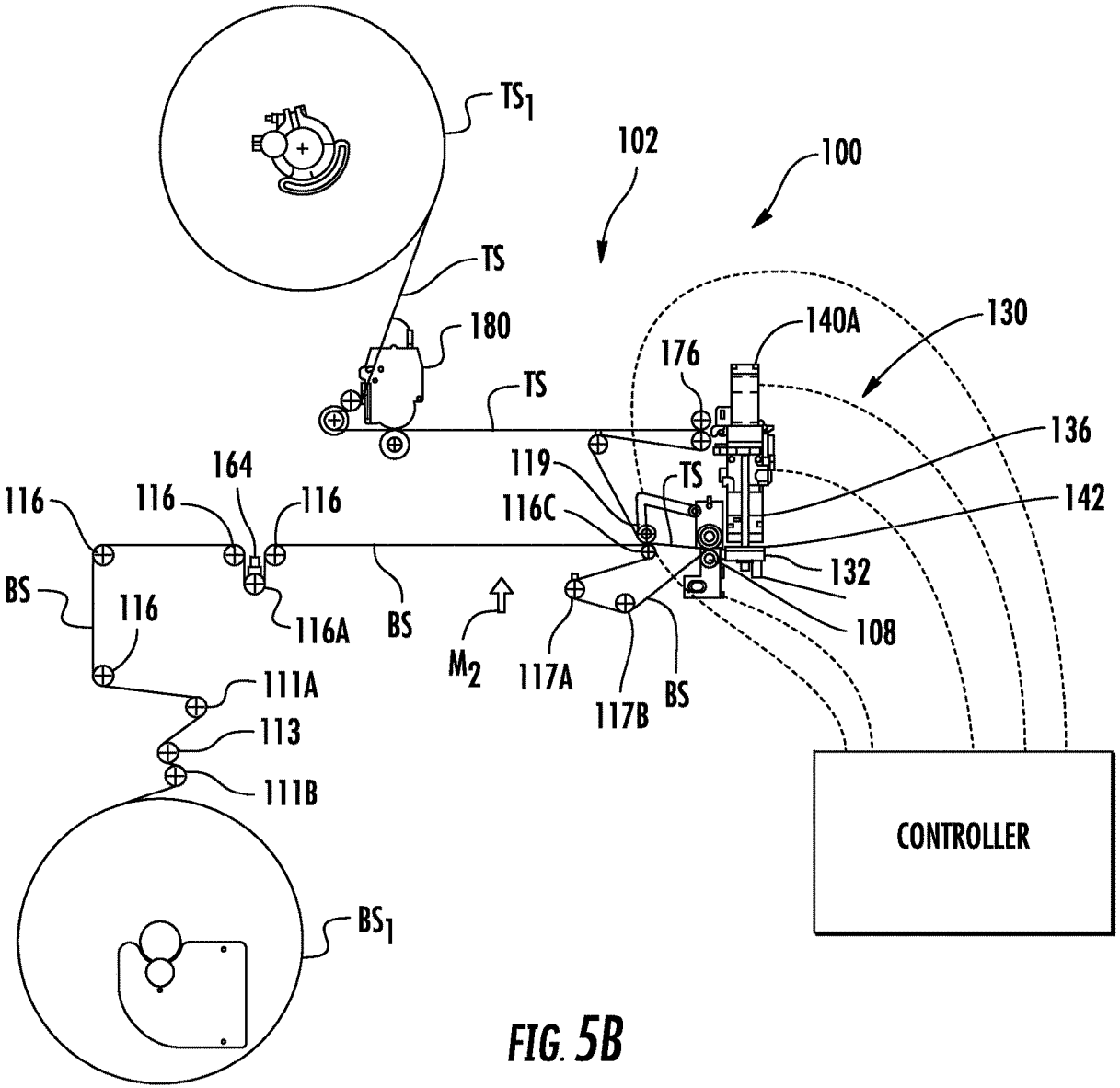
FIG. 5B illustrates a schematic view of the embodiment of the package forming system according to FIG. 5A with the guide tension roller secured to the adjustable table (not shown) in an upper position.

The sides of the top and bottom sheet materials TS, BS can be secured between the nips of the two sets of rollers 108 (of which only one set is shown in FIGS. 3A, 5A and 5B, but similar to the sets of rollers $SR_1$ and $SR_2$ shown in FIG. 1A) on either side of the pathway PA of the top and bottom sheet materials TS, BS. The two sets of rollers 108 can comprise drive rollers that move the top and bottom sheet materials TS. BS as well as the product to be packaged along the pathway PA and through the package forming system 100. A plurality of tension rollers 116 can also be provided to aid in holding the top and bottom sheet materials TS, BS under proper tension for forming the packages around the different sized products that are process through the package forming system 100. The sets of rollers 108 can be pressurized or weighted to create a pressure high enough to seal the sides of the package being formed by the top and bottom sheet materials TS, BS. To adjust the package forming system 100 to package different sized products, the adjustable support table 110 can be provided that can be automatically adjusted up and/or down depending on the estimated height of the product to be package, which can include one or more items.

Figure 4A:
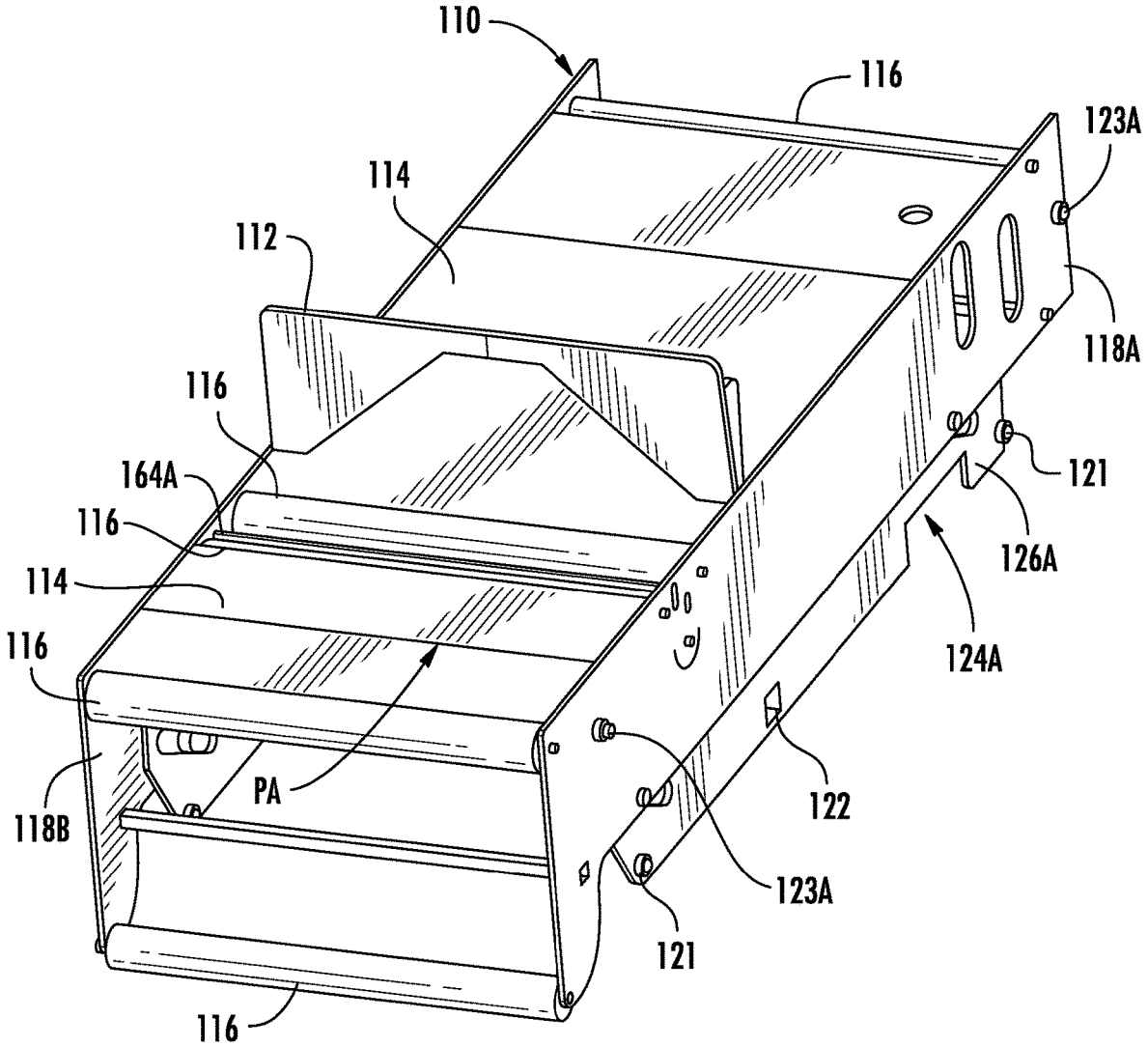
FIG. 4A illustrates a top perspective view of an embodiment of an adjustable table that can be used in the embodiment of the package forming system according to FIG. 3A.
Figure 4B:
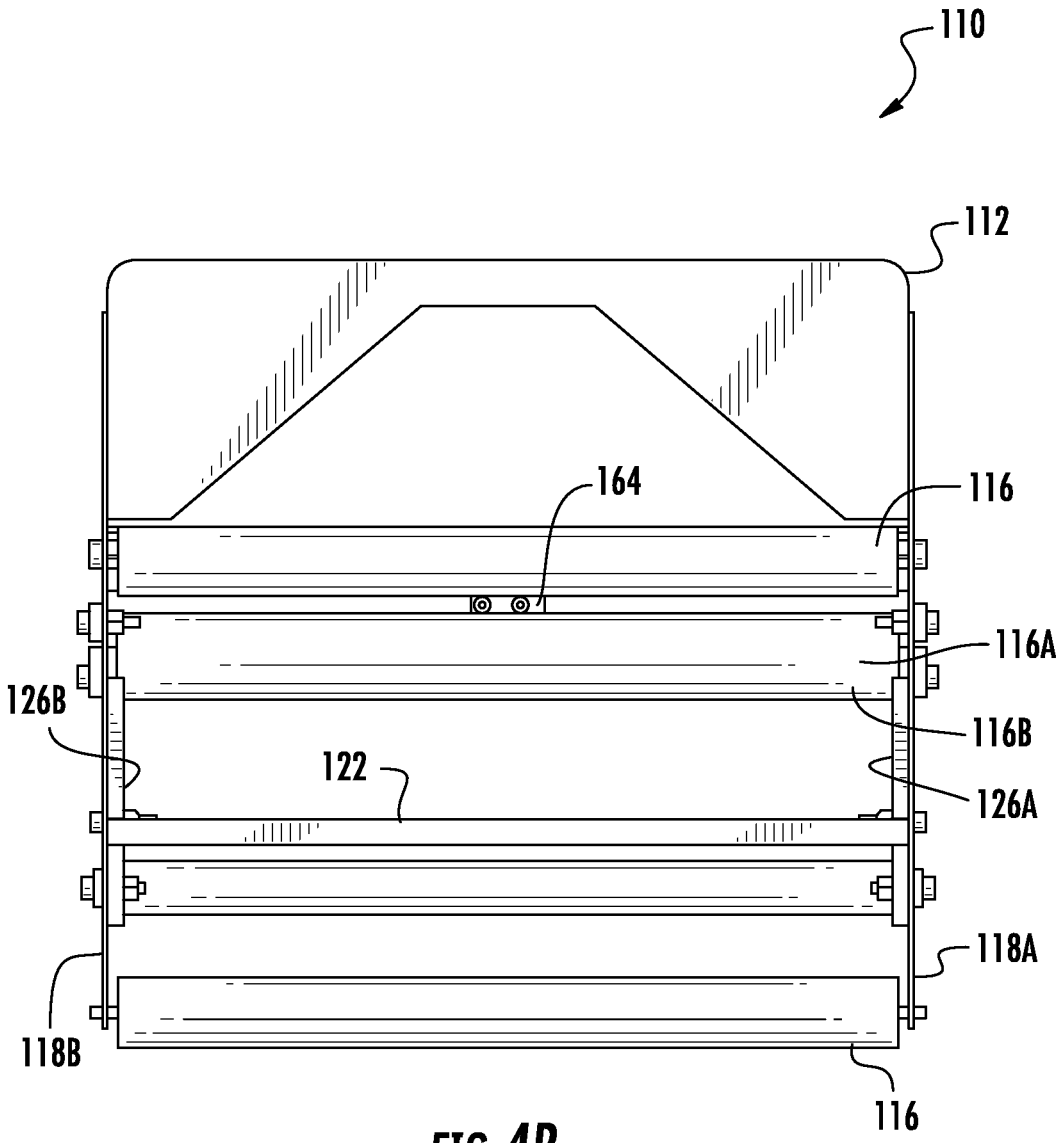
FIG. 4B illustrates a front view of the embodiment of the adjustable table according to FIG. 4A.
Figure 4C:
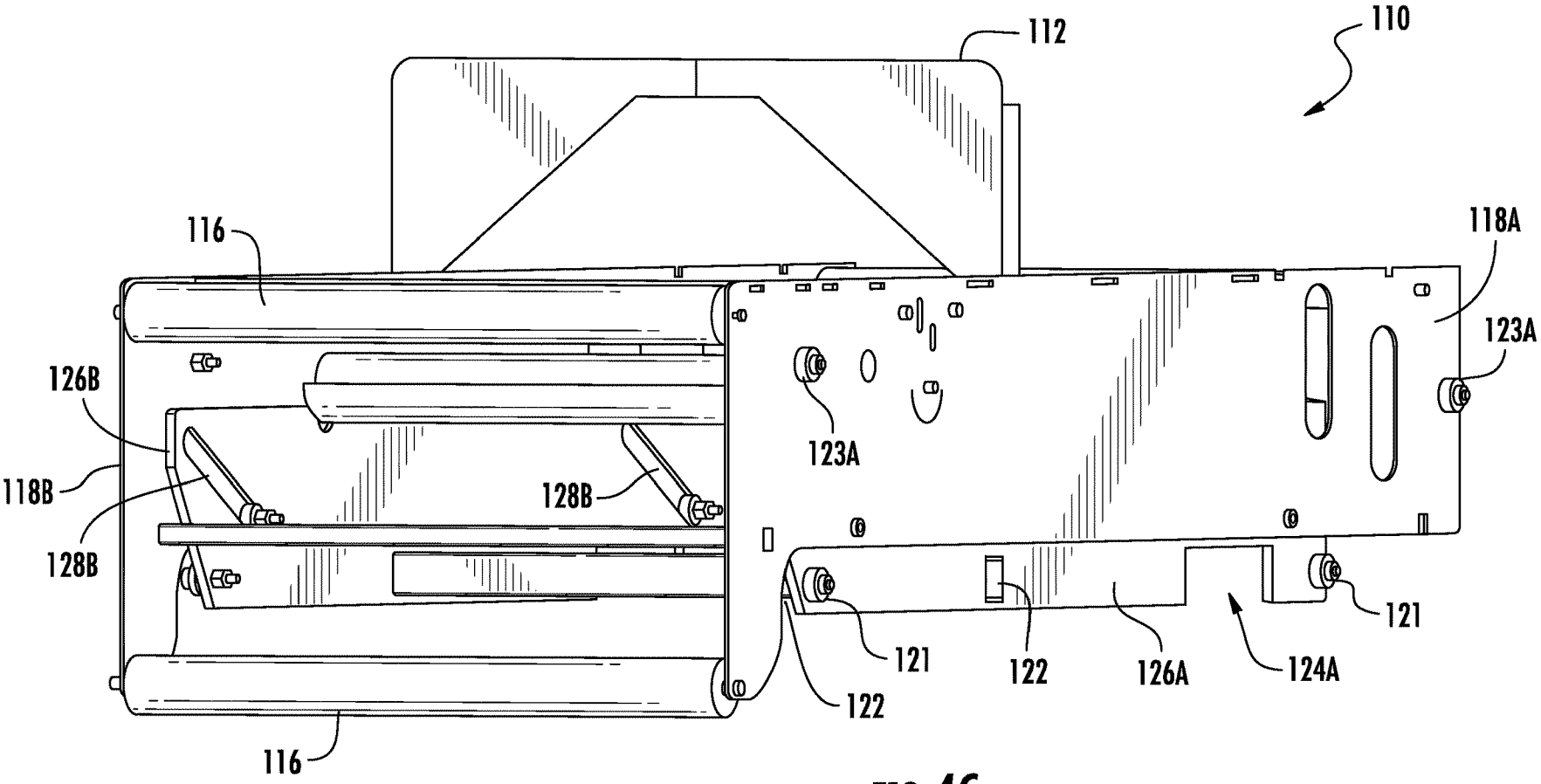
FIG. 4C illustrates a front side perspective view of the embodiment of the adjustable table according to FIG. 4A.
Figure 4D:
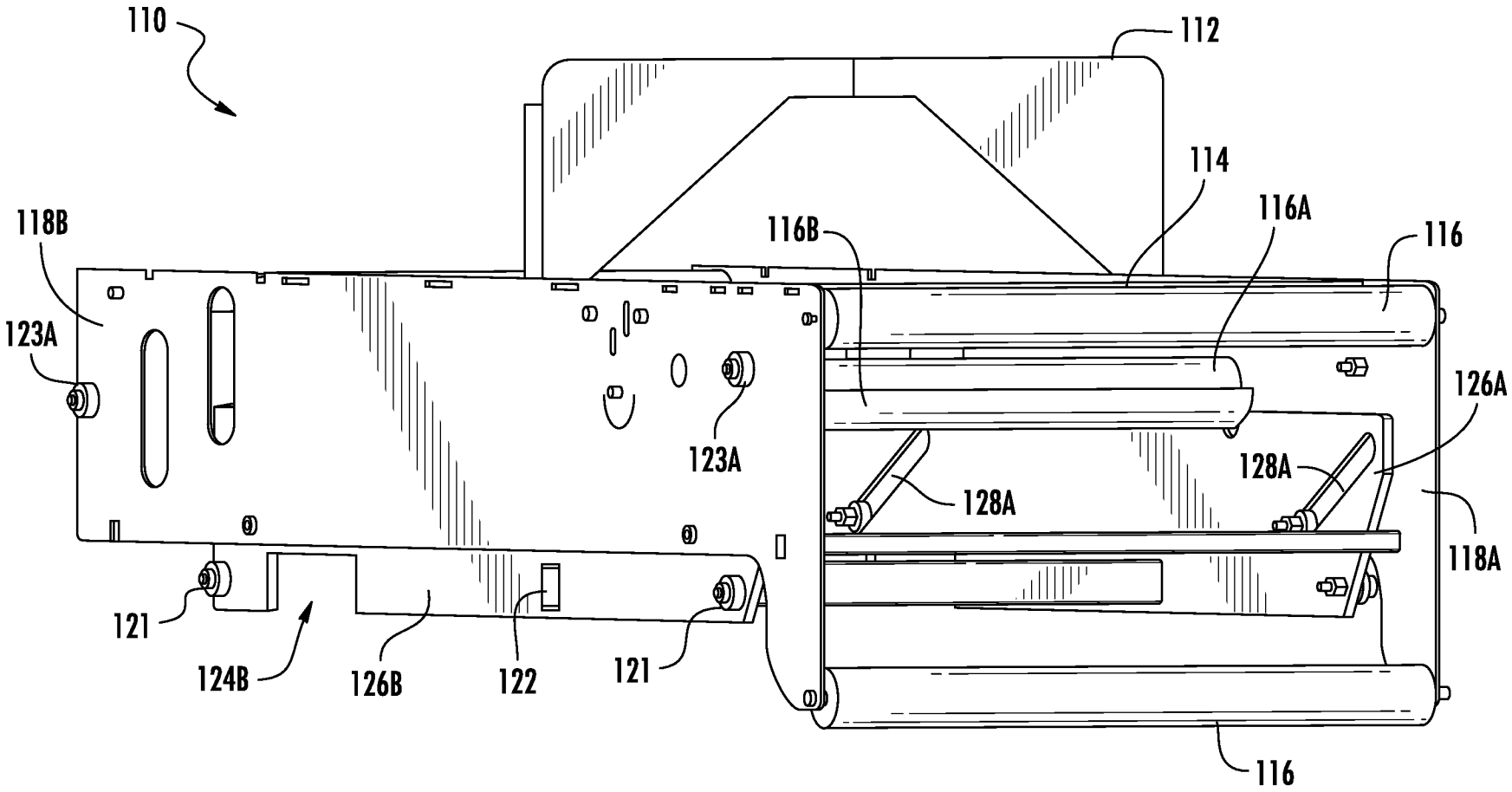
FIG. 4D illustrates a front side perspective view of the embodiment of the adjustable table according to FIG. 4A.
Figure 4E:
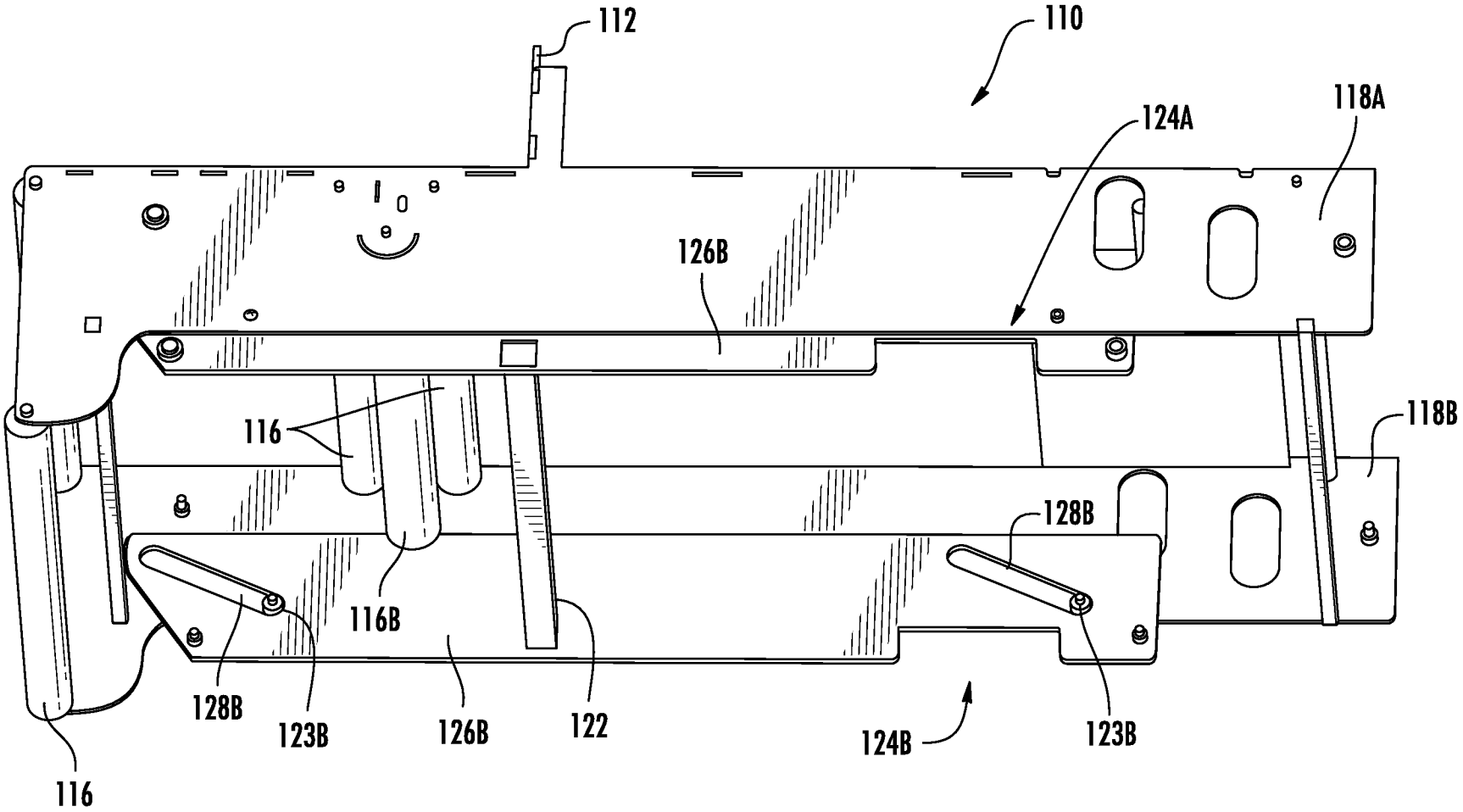
FIG. 4E illustrates a side bottom perspective view of the embodiment of the adjustable table according to FIG. 4A.
Figure 4F:
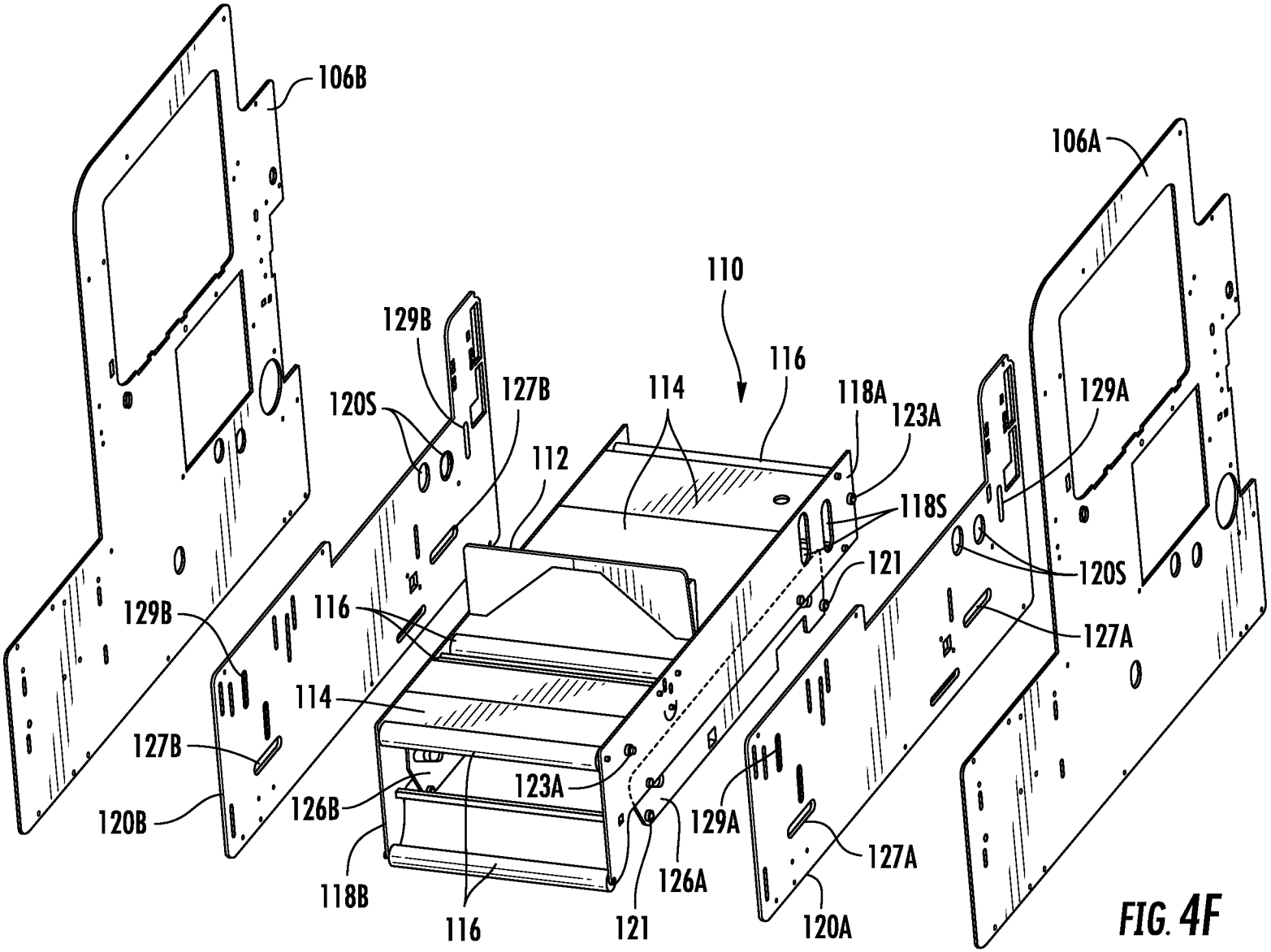
FIG. 4F illustrates an exploded view of the embodiment of the adjustable table according to FIG. 4A.

The adjustable support table 110 can be movably secured to the frame 106 to allow the adjustable support table 110 to be moved upwardly and downwardly to facilitate accommodation of a wide variety of different sized products that can vary in height and length. The adjustable support table 110 can be secured to the frame 106 in a variety of difference manners and can have difference adjustment mechanisms to allow for movement of the adjustable support table 110 upwardly and downwardly. In some embodiments, as shown in FIGS. 3A-3F and 4A-4F, the adjustable support table 110 can comprise a table top 114 that are secured to moveable inner side panels 118A, 118B. The table top 114 and inner side panels 118A, 118B can be moved upwardly or downwardly relative to the nip rollers 108, or side forming rollers to allow for automatic accommodation of products with different heights based on measurements taken of the heights of products. As shown in FIG. 4A, the adjustable support table 110 can comprise outer side panels 120A, 1208 that can be secured to the outer frame side panels 106A, 106B and can be considered generally stationary in that the outer side panels 120A, 120B do not move with the table top 114 and inner side panels 118A, 118B when these components are being adjusted upwardly or downwardly. As shown in FIGS. 3A-3H, in some embodiments, the outer side panels 120A, 120B can be secured to the frame 106 that have support legs that support at a working height the table 110. The frame can be considered a part of the table 110 in some such embodiments. In some embodiments, the outer side panels 120A, 120B can comprise or be secured to a plurality of legs (not shown). In some such embodiments, the outer side panels of the adjustable table can serve as the frame of the package forming system. In such embodiments, safety guards can be placed around exposed portions of the outer side panels that comprise one or more movable components.

In the embodiment shown in FIGS. 3A-3F and 4A-4F, the table 110 supporting the bottom sheet material BS for the pathway PA that the products to packaged travel. In particular, the table top 114 supports the bottom sheet material BS, which acts a conveyor of the product being package to carry the product through the package forming system 100. The table 100 can also comprise a placement gate 112 that can aid in centering products to be packaged based on the height of the products and prevent products, which can contain multiple items, that are too tall to be properly packaged in the system 100 from travelling down the pathway PA to where the nip rollers 108 and the cross seal device 130 form the sides and ends of packages. The bottom sheet material BS travels along the table top 114 beneath the placement gate 112. The placement gate 112 can have angled inner side walls that slant toward an inner top wall to form an aperture through which the pathway PA and the bottom sheet material BS passes. The inner top wall of the gate 112 can be centered on the pathway PA and can be about parallel to the table top 114 so that the inner top wall is about centered with and about parallel to the bottom sheet material BS. The inner side walls of the placement gate 112 are angled such that these side walls can help guide the placement of taller products to be packaged toward the center of the bottom sheet material BS to aid in proper alignment of the side edges of the top and bottom sheet materials TS, BS and can prevent products that are too wide for a given height from traveling further down the pathway PA. The size of the aperture formed between the placement gate 112 and the table top 114 and the angle of the inner side walls of the placement gate 112 can be dependent upon the width of the respective top and bottom sheet materials TS, BS being fed into the package forming system 100.

The placement gate 112 can have one or more laser guides (not shown) attached thereto. The laser guides can project a laser liner downward on the bottom sheet material BS in the pathway PA to identify where to place the product to be packaged. For example, placement gate 112 can have laser guides attached thereto that provide lateral and longitudinal laser guide lines that provide a centerline and a forward placement lateral line for placement of the product on the bottom sheet material BS.

The table top 114 and inner side panels 118A, 118B can be moved upwardly or downwardly in different manners and by different configurations and mechanisms. In some embodiments, as shown in FIGS. 3F and 4A-4F, the adjustable support table 110 can further comprise cam plates 126A, 126B in addition to the inner side panels 118A, 118B and the outer side panels 120A, 120B. The cam plates 126A, 126B, inner side panels 118A, 118B, and the outer side panels 120A, 120B can be configured to interact with each other so that linear horizontal movements of the cam plates 126A, 126B can translate to generally upward and downward movement of the table top 114. In particular, in some embodiments, the cam plates 126A, 126B, the inner side panels 118A, 118B, and the outer side panels 120A, 120B, for example, can have respective cam slots and cam members, such as cam rollers, that interact with each other so that linear horizontal movements of the cam plates 126A, 126B, can translate to generally upward and downward movement of the table top 114.

In some embodiments, the cam plates 126A, 126B, for example, can have one or more cam slots 128A, 128B therein and one or more cam members, such as cam rollers 121, that extend outward from an outer side of the cam plates 126A, 126B. Similarly, the inner side panels 118A, 1188 can have one or more cam members, such as cam rollers 123B, that extend inwardly from an inners side of the inner side panels 118A, 118B and one or more cam members, such as cam rollers 123A that extend outwardly from an outer side of the inner side panels 118A, 118B. Additionally, the outer side panels 120A, 120B can have one or more cam slots 127A, 127B and 129A, 129B therein.

In particular in the embodiment shown in FIGS. 3F and 4A-4F, each of the cam plates 126A, 1268 can have two angled slots 128A, 128B therein in which one of the two respective cam rollers 123B that extend inwardly from the respective inner side panels 118A, 118B can reside. Additionally, each of the cam plates 126A, 126B can have two cam rollers 121 protruding outward from a portion positioned below the inner side panels 118A, 118B that engage horizontal slots 127A, 127B in the respective outer side panels 120A, 120B. Each of the inner side panels 118A, 118B can additionally comprise two cam rollers 123A, 123B that extend outwardly toward the respective outer side panels 120A, 120B. These outward extending cam members can extend into cam slots 129A, 129B in outer side panels 120A, 120B in a generally vertical direction.

The cam rollers 121 extending outward from each of the cam plates 126A, 126B extend into the horizontal cam slots 127A, 127B so that as the cam plates 126A, 126B are moved, the horizontal cam slots 127A, 127B ensure this movement is a horizontal movement. As the cam plates 126A, 126B move back and forth in a linear horizontal movement, the cam members 123B extending inward from the inner side panels 118A, 118B ride up and down the angled slots 128A, 128B in the cam plates 126A, 126B. Further, as the cam members 123B extending inward from the inner side panels 118A, 118B ride up and down the angled slots 128A, 128B in the cam plates 126A, 126B, the cam members 123A extending outward from the inner side panels 118A, 118B that engage the generally vertical slots in the outer side panels 120A, 120B direct the movement of the table top 114 and inner side panels 118A, 118B in a generally upward direction or downward direction.

To move the cam plates 126A, 126B, for example, as shown in FIGS. 3F and 4A-4F, the table 110 can be constructed so that the cam plates 126A, 126B can be operated by one or more air cylinders 125. In some embodiments, an adjustable air cylinder can be directly or indirectly secured to the cam plates 126A, 126B and can adjustably move the cam plates 126A, 126B by a desired amount in a horizontal direction causing the cam plates to ride up or down on respective cam members to move the table 110 up or down depending on the direction of movement of the adjustable air cylinder. In some embodiments as shown, multiple air cylinders 125 can work in conjunction to move the cam plates 126A, 126B by a desired amount in a horizontal direction causing the inner side panels to ride up or down on respective cam members to move the table 110 up or down. The different cylinders 125 can raise and lower the table top using the cam plate by varying amounts of distance as desired and designed. The different cylinders 125 can raise and lower the table top in a variety of different increments and total distances depending on the types of products being packaged. For example, multiple cylinders can be used on the table to raise and lower the table top between about 0 inches and about 5 inches with the table top being movable a variety of increments. For instance, in some embodiments, the table can move in increments of about ⅛ of an inch, about ¼ of an inch, about ½ of an inch, about 1 inch or about 2 inch. In another example, a first air cylinder can raise the table about an eighth (⅛) of an inch, a second air cylinder can raise the conveyor about a quarter (¼) of an inch, a third air cylinder can move the table up about a half (½) of an inch, while a fourth air cylinder can raise the table up about one (1) inch. By using these cylinders, the top table can move up or down from 0 inches to about 1⅞ inches. By using these cylinders, the table can be moved up or down from 0 inches to about 1⅞ inches of eighth (⅛) of an inch increments.

In particular, the cylinders 125 can be secured to a cross bar 122 that is secured to the cam plates 126A, 126B on a first end and to a cross bar 124 that is secured to the outer side panels 120A, 120B or the outer frame side panels 106A, 106B on a second end. By the cross bar 124 being attached to the outer frame side panels 106A, 106B or to the outer side panels 120A, 120B, which are held stationary by being secured to the outer frame side panels 106A, 106B, the second end of the cylinders 125 are held stationary while the first end of the cylinders 125 secured to the cross bar 122 attached to the cam plates 126A, 126B moves with the cam plates 126A, 126B as the cylinders 125 are activated. The cam plates 126A, 126B can have cross bar grooves, or slots, 124A in which the cross bar 124, which is attached to the outer side panels 120A, 120B of the table 110, can reside. As the cylinders 125 move the cam plates 126A, 126B, the cam plates 126A, 126B can slide over the cross bar 124 within the cross bar grooves 124A.

Thus, as the cylinders 125 push the cross bar 122 and the cam plates 126A, 126B attached thereto in one direction and as the cam plates 126A, 126B slide over the cross bar 124 within the cross bar grooves 124A, the cam rollers 121 extending outward from the cam plates 126A, 126B slide horizontally within the horizontal slots 127A, 127B in the outer side panels 120A, 120B while the cam rollers 123B extending inward from the inner side panels 118A, 118B slide downward in the angled slots 128A, 128B and the cam rollers 123A extending outward from the inner side panels 118A, 118B move downwardly within the generally vertical slots in the outer side panels 120A, 120B with the table top 114 and inner side panels 118A, 118B moving downward.

Conversely, as the cylinders 125 pull the cross bar 122 and the cam plates 126A, 126B in the opposite direction, the cam rollers 121 extending outward from the cam plates 126A, 126B slide horizontally within the horizontal slots 127A, 127B in the outer side panels 120A, 120B while the cam rollers 123B extending inward from the inner side panels 118A, 118B slide upward in the angled slots 128A, 128B and the cam rollers 123A extending outward from the inner side panels 118A, 118B move upwardly within the generally vertical slots in the outer side panels 120A, 120B with the table top 114 and inner side panels 118A, 118B moving upward.

As the table top 114 and inner side panels 118A, 118B move upward and downward, the tension rollers 116 attached to the inner side panels 118A, 118B can move upward and downward with the inner side panels 118A, 118B. Further, the outer side panel panels 120A, 120B can comprise tension rollers 117A, 117B secured between the outer inner side panels. Thereby, the tension rollers attached to the inner side panels can move upward and downward with the inner side panels as the table top and inner side panels move upward and downward while the tension rollers attached to the outer side panels remain stationary with the outer side panels as the table top and inner side panels move upward and downward. Such an arrangement of moveable and stationary tension rollers (both sets of tension rollers being capable of rotating about a respective axis) can aid the respective cam members and cam slots in the cam plates, the moveable inner side panels and the outer side panels in maintaining the tension in the bottom sheet material BS without causing a pulling displacement of the sheet material when the table 110 moves upward and a bunching of excess sheet material as the table 110 moves downward.

To maintain the tension in the bottom sheet material BS without causing a pulling displacement of the sheet material when the table 110 moves upward and a bunching of excess sheet material as the table 110 moves downward, the translation of the lateral movements of the cam plates 126A, 126B to the upward and downward movement of the table 110 can be such that the upward and downward movement of the table 110 is at a slight angle off perpendicular. Thus, the cam slots in the outer side panels 120A, 120B can extend vertically at a slight angle off perpendicular. For example, in some embodiments, the cam slots in the outer side panels 120A, 120B can extend vertically at an angle of between about 1° and about 5° off perpendicular. In some embodiments, the cam slots in the outer side panels 120A, 120B can extend vertically at an angle of between about 2° off perpendicular. Thus, in some embodiments, the upward and downward movement of the table 110 can be at an angle of between about 1° and about 5° off perpendicular. In some embodiments, the upward and downward movement of the table 110 can be at an angle of between about 2° off perpendicular. Additionally, some of the tension rollers proximate to the location where the top and bottom sheet materials TS, BS enter between the nip rollers 108 on either side of the top and bottom sheet materials TS, BS can be stationary relative to the table to maintain the proper tensioning in the bottom sheet material BS. The inner side panels 118A, 118B can have angle slots formed therein to accommodate these stationary tension rollers.

Additionally, horizontal slots can be provided in the outer side panels 120A, 120B of the table 110 that can be engaged by outward extending members of the cam plates 126A, 126B. As the cam plates 126A, 126B are moved back and forth, the outward extending members on the cam plates 126A, 126B move within the horizontal slots in the outer side panels 120A, 120B of the table 110 to keep the movement of the cam plates 126A, 126B in a horizontal directional. Thereby, the movement of the cam plates 126A. 126B can be limited to horizontal movement.

For example, as shown in FIGS. 5A and 5B, schematic views are provided of the travel paths for the top and bottom sheet material guide systems 102 and 104, including associated tension rollers for the top and bottom sheet materials TS, BS leading into the two sets nip rollers 108 with the table moved in a direction $M_1$ to an upward position in FIG. 5B and moved in a direction $M_2$ to a downward position in FIG. 5A. As the top and bottom sheet materials TS, BS are pulled off the respective top sheet material roll $TS_1$ and bottom sheet material roll BS, by the drive the two sets of nip rollers 108, top and bottom sheet material BS travel around the various tension rollers 116 of which at least some are secured to and move upwardly and downwardly with the adjustable table 110 (shown in FIGS. 4A-4F). A controller 150 can be used to start and stop the two sets of nip rollers 108 that start and stop the travel of the top and bottom sheet materials TS, BS and can be used to automatically raise and lower the height of the adjustable table 110 (shown in FIGS. 4A-4F), for example, based on measurements taken of the height of the product to be packaged or based on placement of the package on the product pathway by an operator. The controller, as explained further below can be a variety of computing devices, such as various types of computers, programmable logic controllers, smart tablet or cellular devices, or the like, or combinations of such computing devices that can operate the package forming system 100. Based on measurements of the length of the products to be packaged provided to the controller 150, the controller 150 can also operate the cross seal device 130 to form and seal the ends of the packages around the respective products being packaged as explained in more detail below.

To aid in ensuring that the bottom sheet material BS does not improperly pull a product being packaged forward or create undesirable slack in the bottom sheet material BS, the package forming system 100 and bottom sheet material guide system 104 can include tension rollers 117A, 117B that are rotatably secured to, for example, the outer side panels 120A, 120B or the outer frame side panels 106A, 106B. In some embodiments as some in FIG. 4F, generally vertical slots 118S can be provided in the inner side panels 118A, 118B that travel upwardly and downwardly with the table top 114 and apertures 120S can be provided in the outer side panels 120A, 120B to accommodate the tension rollers 117A, 117B that can be secured to the outer frame side panels 106A, 106B. These stationary tension rollers 117A, 117B, while rotatable, are stationary in their position relative to the adjustable table 110 as it is moved up and down. These stationary tension rollers 117A, 1178 can be positioned far enough below the table top 114 so as to not interfere with the movement of the table top 114 or the movement of the bottom sheet material 85. By having a guide tension roller 116C that is secured to the table 110 and farthest inward along the pathway PA and closest to the sets of nip rollers 108 and the cross seal device 130, the bottom sheet material BS can act as conveyor before the package begins to be formed. The bottom sheet material BS can wrap around the guide tension roller 116C and then move back and downward around the stationary tension rollers 117A, 117B before extending upward from the stationary tension roller 1178 to the sets of nip rollers 108 that engage the side edges of the top and bottom sheet materials TS, BS. The slight angle off perpendicular of the movement of the table top 114 (shown in FIGS. 4A-4F) and the position of the stationary tension rollers 117A, 117B relative to the guide tension roller 116C as well as the fact that these stationary tension rollers 117A, 117B stay in the same position relative to the movement of the table top 114 and guide tension roller 116C can help prevent improper alignment of the bottom sheet material BS as it conveys products toward the sets of nip rollers 108 and the cross seal device 130. Additionally, as shown in FIGS. 5A and 5B, the package forming system 100 and bottom sheet material guide system 104 can include stationary rotatable tension rollers 111A, 111B on the front end of the guide system 104 proximal to the bottom sheet material roller BS, and a fixed tube 113 that creates a drag on the sheet material BS that also aid in ensuring that the bottom sheet material BS does not improperly pull a product being packaged forward or create undesirable slack in the bottom sheet material BS. The stationary rotatable tension rollers 111A, 111B stay in the same position relative to the movement of the table top 114 and front tension rollers 116 to help prevent improper alignment of the bottom sheet material BS as it conveys products toward the sets of nip rollers 108 and the cross seal device 130 in a similar manner as the stationary rotatable tension rollers 117A, 117B described above. As stated, the fixed tube 113 that creates a drag on the sheet material BS that also can help prevent improper alignment of the bottom sheet material BS as it conveys products toward the sets of nip rollers 108 and the cross seal device 130. The set of tensioning rollers 116 shown in FIGS. 5A and 5B near the roll $BS_1$ of bottom sheet material can also be used to help track the bottom sheet material BS in a similar manner to the guide tension roller 116C and the stationary tension rollers 117A, 117B described above. Two of the tensioning rollers 116 near the roll $BS_1$ can be stationary while a third roller 116 attached to the adjustable table at the bottom of the front end can move with the table as the table is adjusted. Thus, in a similar manner as described above, the set of tensioning rollers 116 near the roll $BS_1$ of bottom sheet material can be used to aid in ensuring that the bottom sheet material BS does not improperly pull a product being packaged forward or create undesirable slack in the bottom sheet material BS.

As shown in FIGS. 3A-3F and 6, the package forming system 100 can further comprise a controller 150 that can be in communication with the sensors 160, 162, 164 and in communication with a drive system (not shown) that can power the package forming system 100 to control the operation of the package forming system 100. The controller 150 can also be in communication with the driver system (not shown) that can be used to adjust the support table 110 upwardly or downwardly. The controller 160 can comprise any capable processing unit, such as a programmable logic controller ("PLC"), a desktop computer, a laptop computer, a mini computer, or the like, including combinations thereof. The controller 150 can process the information provided the sensors mentioned above as well as other sensors and information that the controller 50 can use to effectively operate the package forming system 100.

Regarding the adjustment of the table 110, the controller 150 can obtain and process information from the sensors, such as a height sensor 162 in some embodiments or one or more sensors 164 that can be used to measurement s distance representative of the length of a bottom sheet material on which the product is placed from a measuring point where the package being formed is to begin to a leading edge LE of the product P, to determine whether the table 110 should be moved upward or downward as described above to position the table 110 such that the centerline of the product aligns properly with the nips of the set of side rollers 108 and the center line of the cross seal device 130. The controller 150 can then communicate with a drive system (not shown) that moves the table 110 up and down to move the table 110 to the desired position at the appropriate time once the product that was measured is placed on the bottom sheet material BS and the table 110.

Figure 6:
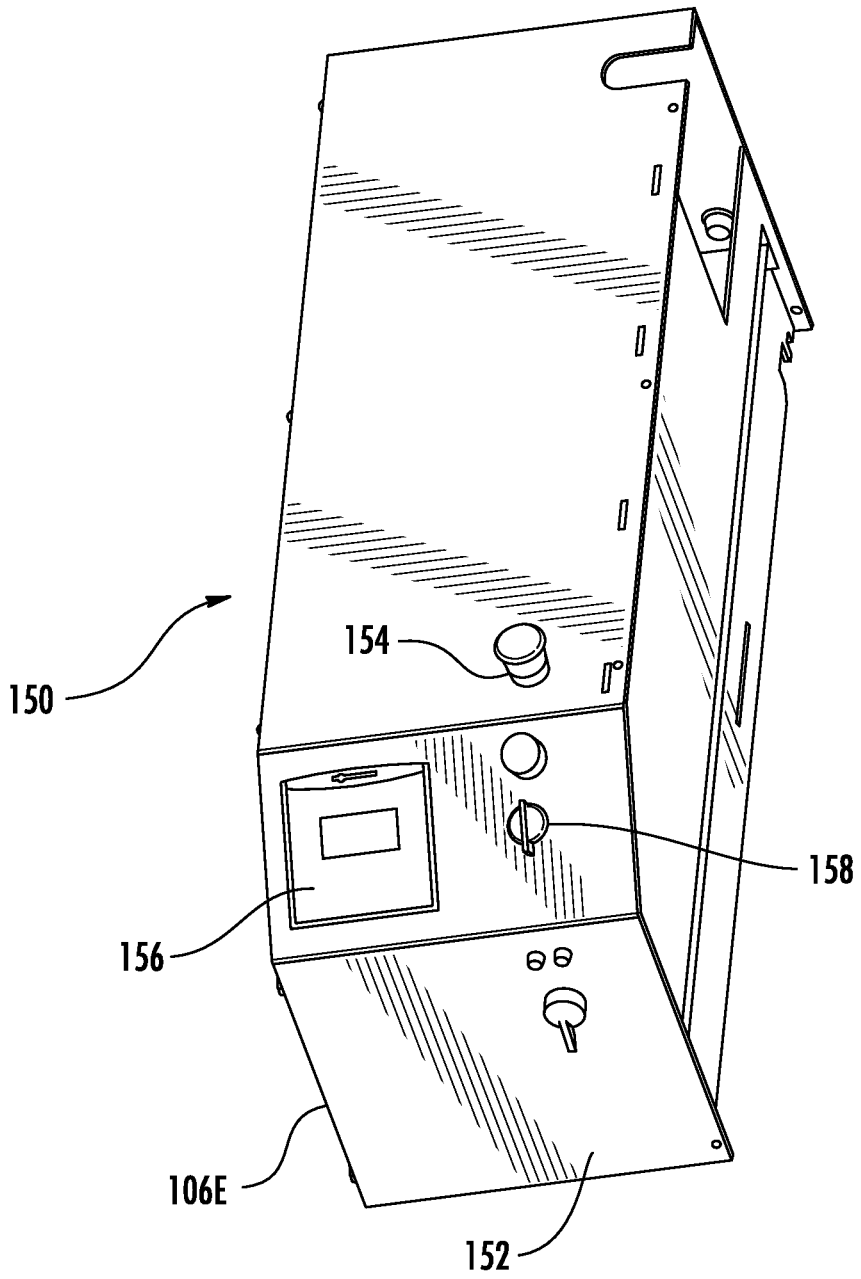
FIG. 6 illustrates a front perspective view of an embodiment of a controller that can be used in the embodiment of the package forming system according to FIG. 3A.

In some embodiments as shown in FIG. 6, the controller 150 can be encased by a housing 106E. The controller 150 can include an on-off switch 152 for turning on the package forming system 100 and an emergency stop, or E-stop button 154. The controller 150 can also include a display 156 that can be used to display pertinent information to operator as needed. The controller 150 can further include a switch 158 can be used to drive the bottom sheet materials TS, BS within the package forming system 100 by activating the nip rollers 108. The controller 150 can also comprise an operation button and can be pushed to advance the products being packaged within the package forming system 100 as certain criteria are met. For example, the operation button can be able to be lit green to indicate to the operator that the product can be advanced within package forming system 100 after height, length, and/or weight measurement and placement of the product in the package forming system 100.

As outlined above, the packaging forming system can operate under a variety of different methods as outlined above. For example, a method of moving a table top of an adjustable table in a packaging forming system can be provided that includes various steps. For instance, the method can comprise providing an adjustable table for use in a packaging forming system. The adjustable table can comprise outer side panels and moveable inner side panels that are moveably connected to the outer side panels. The outer side panels are held stationary relative to the moveable inner side panels. The adjustable table can also comprise a table top secured to the moveable inner side panels. The table top and the inner side panels are configured to move upwardly or downwardly relative to the outer side panels. The method can further comprise moving the moveable inner side panels relative to the outer side panels to move the table top upwardly or downwardly relative to the outer side panels.

In some embodiments of the method, the adjustable table can comprise cam plates movably connected to the moveable inner side panels and the outer side panels. In such embodiments of the method, the step of moving the moveable inner side panels relative to the outer side panels can comprise moving the cam plates the cam plates in a linear horizontal movements to generate a generally upward and downward movement of the table top. In some embodiments of the method, the method also comprises engaging two cam rollers protruding outward from the cam plate from a portion positioned below the inner side panels with horizontal slots in the respective outer side panels so that, during movement of the cam plate, the cam plates are moved in a horizontal movement.

In some embodiments of the method, the method also comprises engaging two angled slots in the cam plate with respective cam rollers that extend inwardly from the respective inner side panels. In such embodiments of the method, the step of moving the moveable inner side panels relative to the outer side panels can comprise moving the cam plate back and forth in a linear horizontal movement so that the cam members extending inward from the inner side panels ride up and down the angled slots in the cam plates.

In some embodiments of the method, each of the inner side panels can comprise two cam rollers that extend outwardly toward the respective outer side panels. The outward extending cam rollers of each of the inner side panels can extend into corresponding cam slots in the outer side panels that extend in a generally vertical direction. In such embodiments of the method, the step of moving the moveable inner side panels relative to the outer side panels can comprise linearly moving the cam plate so that the cam rollers extending inward from the inner side panels ride up or down the angled slots in the cam plates, while the cam members extending outward from the inner side panels that engage the generally vertical slots in the outer side panels direct the movement of the table top and the inner side panels in a generally upward direction or downward direction.

In some embodiments, the table can be constructed with cam plates operated by four (4) air cylinders. The different cylinders can raise and lower the table using the cam plate by varying amounts of distance as desired and designed. For example, a first air cylinder can raise the table about an eighth (⅛) of an inch, a second air cylinder can raise the conveyor about a quarter (¼) of an inch, the third air cylinder can move the table up about a half (½) of an inch, while a fourth air cylinder will can raise the table up about one (1) inch. By using these cylinders, the table can move up or down from 0 inches to about 1⅞ inches.

These and other modifications and variations to the present subject matter may be practiced by those of ordinary skill in the art, without departing from the spirit and scope of the present subject matter, which is more particularly set forth herein above and any appending claims. In addition, it should be understood the aspects of the various embodiments may be interchanged either in whole or in part. Furthermore, those of ordinary skill in the art will appreciate that the foregoing description is by way of example only, and is not intended to limit the present subject matter.

What is claimed is:

1. A method of moving a table top of an adjustable table in a packaging forming system, the method comprising:
   - providing an adjustable table for use in a packaging forming system, the adjustable table comprising:
     - outer side panels;
     - moveable inner side panels moveably connected to the outer side panels with the outer side panels held stationary relative to the moveable inner side panels; and a table top secured to the moveable inner side panels, the table top and the inner side panels configured to move upwardly or downwardly relative to the outer side panels; and cam plates movably connected to the moveable inner side panels and the outer side panels; and moving the moveable inner side panels relative to the outer side panels by moving the cam plates in linear horizontal movements to generate a generally upward and downward movement of the table top.

2. The method according to claim 1, wherein the step of moving the moveable inner side panels relative to the outer side panels by moving the cam plates in linear horizontal movements to generate a generally upward and downward movement of the table top comprises operating the cam plates using multiple air cylinders, the multiple air cylinders working in conjunction to move the cam plates by a desired amount in a horizontal direction causing the movable inner panels to ride up or down on respective cam members to move the table top up or down with each cylinder of the multiple cylinders configured to raise and lower the table using the cam plate by a different distance such that the table top is movable up or down from 0 inches up to about 5 inches.

3. The method according to claim 2, wherein operating the cam plates using multiple air cylinders comprises moving the table top up or down from 0 inches to about 1⅞ inches in about eighth (⅛) of an inch increments.

4. An adjustable table for use in a packaging forming system, the adjustable table comprising:

outer side panels;

moveable inner side panels moveably connected to the outer side panels with the outer side panels held stationary relative to the moveable inner side panels; and a table top secured to the moveable inner side panels, the table top and the inner side panels configured to move upwardly or downwardly relative to the outer side panels; and cam plates movably connected to the moveable inner side panels and the outer side panels, the cam plates, the inner side panels, and the outer side panels configured to interact with each other so that linear horizontal movements of the cam plates translate to generally upward and downward movement of the table top.

5. The adjustable table according to claim 4, wherein the table top is configured to support bottom sheet material used to form a side of a package along a pathway on which one or more products to packaged travel.

6. The adjustable table according to claim 4, further comprising a placement gate attached to the table top that can aid in centering products to be packaged based on the height of the products.

7. The adjustable table according to claim 6, wherein inner side walls of the placement gate are angled such that these side walls can help guide the placement of taller products to be packaged toward a center of the bottom sheet material to aid in proper alignment of the side edges of the bottom sheet material and a side edge of a top sheet material.

8. The adjustable table according to claim 6, wherein the placement gate comprises one or more laser guides, the laser guides configured to project one or more laser liners downward on the bottom sheet material in the pathway to identify where to place the product to be packaged.

9. The adjustable table according to claim 4, further comprising multiple air cylinders configured to operate the cam plates, the multiple air cylinders working in conjunction to move the cam plates by a desired amount in a horizontal direction causing the movable inner panels to ride up or down on respective cam members to move the table top up or down with each cylinder of the multiple cylinders configured to raise and lower the table using the cam plate by a different distance such that the table top is movable up or down from 0 inches up to about 5 inches.

10. The adjustable table according to claim 9, wherein the table top can be moved up or down from 0 inches to about 1⅞ inches in about eighth (⅛) of an inch increments.

11. The adjustable table according to claim 10, wherein the multiple cylinders comprise a first air cylinder can raise the table about an eighth (⅛) of an inch, a second air cylinder can raise the conveyor about a quarter (¼) of an inch, a third air cylinder can move the table up about a half (½) of an inch, while a fourth air cylinder will can raise the table up about one (1) inch.

12. The adjustable table according to claim 9, wherein each of the multiple cylinders are secured to a cross bar that is secured to the cam plates on a first end of each of the respective multiple cylinders and to a cross bar that is secured to the outer side panels at a second end of each of the respective multiple cylinders such that the second ends of the multiple cylinders are configured to be held stationary while the first end of the cylinders secured to the cross bar attached to the cam plates are configured to move with the cam plates as the multiple cylinders are activated.

13. The adjustable table according to claim 4, wherein the moveable inner side panels comprise tension rollers secured between the moveable inner side panels such that the tension rollers attached to the inner side panels can move upward and downward with the inner side panels as the table top and inner side panels move upward and downward and the outer side panels comprise tension rollers secured between the outer inner side panels such that the tension rollers attached to the inner side panels move upward and downward with the inner side panels as the table top and inner side panels move upward and downward and the tension rollers attached to the outer side panels remain stationary with the outer side panels as the table top and inner side panels move upward and downward.

14. The adjustable table according to claim 4, wherein the linear horizontal movements of the cam plates move the table top in at least one of an upward or downward movement in different increments.

15. An adjustable table for use in a packaging forming system, the adjustable table comprising:

a frame;

outer side panels secured to the frame;

moveable inner side panels moveably connected to the outer side panels;

a table top secured to the moveable inner side panels, the table top and the inner side panels configured to move upwardly or downwardly relative to the outer side panels; and one or more laser guides positioned proximate to the table top, the laser guides configured to project one or more laser liners downward on the bottom sheet material in the pathway to identify where to place the product to be packaged.

16. The adjustable table according to claim 15, wherein the table top is configured to support bottom sheet material used to form a side of a package along a pathway on which one or more products to packaged travel.

17. The adjustable table according to claim 15, further comprising cam plates movably connected to the moveable inner side panels and the outer side panels, the cam plates, the inner side panels, and the outer side panels configured to interact with each other so that linear horizontal movements of the cam plates translate to generally upward and downward movement of the table top.

18. The adjustable table according to claim 17, wherein the cam plates are operated by multiple air cylinders that work in conjunction to move the cam plates by a desired amount in a horizontal direction causing the movable inner panels to ride up or down on respective cam members to move the table top up or down.

19. The adjustable table according to claim 18, wherein each cylinder of the multiple cylinders is configured to raise and lower the table using the cam plate by a different distance.

20. The adjustable table according to claim 19, wherein the table top can be moved up or down from 0 inches to about 1⅞ inches in about eighth (⅛) of an inch increments.

21. The adjustable table according to claim 18, wherein each of the multiple cylinders are secured to a cross bar that is secured to the cam plates on a first end of each of the respective multiple cylinders and to a cross bar that is secured to the outer side panels at a second end of each of the respective multiple cylinders such that the second ends of the multiple cylinders are configured to be held stationary while the first end of the cylinders secured to the cross bar attached to the cam plates are configured to move with the cam plates as the multiple cylinders are activated.

* * * * *